US011125056B2

(12) United States Patent
Parks et al.

(10) Patent No.: US 11,125,056 B2
(45) Date of Patent: *Sep. 21, 2021

(54) PERFORATION GUN COMPONENTS AND SYSTEM

(71) Applicant: DynaEnergetics Europe GmbH, Troisdorf (DE)

(72) Inventors: David C. Parks, Calgary (CA); Frank Haron Preiss, Bonn (DE); Liam McNelis, Bonn (DE); Eric Mulhern, Edmonton (CA); Thilo Scharf, Letterkenny (IE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/920,812

(22) Filed: Mar. 14, 2018

(65) Prior Publication Data

US 2018/0202790 A1 Jul. 19, 2018

Related U.S. Application Data

(60) Continuation of application No. 15/617,344, filed on Jun. 8, 2017, now Pat. No. 10,429,161, which is a (Continued)

(30) Foreign Application Priority Data

Jul. 18, 2013 (CA) ..... 2821506

(51) Int. Cl.
*F42D 1/02* (2006.01)
*E21B 43/1185* (2006.01)
(Continued)

(52) U.S. Cl.
CPC ..... *E21B 43/1185* (2013.01); *E21B 43/119* (2013.01); *E21B 43/11855* (2013.01);
(Continued)

(58) Field of Classification Search
CPC ..... F42D 1/02; F42D 1/043; E21B 43/11855
(Continued)

(56) References Cited

U.S. PATENT DOCUMENTS

| | | | |
|---|---|---|---|
| 2,216,359 | A | 10/1940 | Spencer |
| 2,228,873 | A | 1/1941 | Hardt et al. |
| 2,358,466 | A | 9/1944 | Miller |
| 2,418,486 | A | 4/1947 | Smylie |
| 2,785,631 | A | 3/1957 | Blanchard |

(Continued)

FOREIGN PATENT DOCUMENTS

| | | |
|---|---|---|
| CA | 2821506 A1 | 1/2015 |
| CA | 2824838 A1 | 2/2015 |

(Continued)

OTHER PUBLICATIONS

Intellectual Property India, Office Action of IN Application No. 201647004496, dated Jun. 7, 2019, which is in the same family as U.S. Appl. No. 15/920,812, 6 pgs.

(Continued)

*Primary Examiner* — J. Woodrow Eldred
(74) *Attorney, Agent, or Firm* — Moyles IP, LLC

(57) ABSTRACT

Components for a perforation gun system are provided including combinations of components including a self-centralizing charge holder system and a bottom connector that can double as a spacer. Any number of spacers can be used with any number of holders for any desired specific metric or imperial shot density, phase and length gun system.

20 Claims, 18 Drawing Sheets

Related U.S. Application Data division of application No. 15/287,309, filed on Oct. 6, 2016, now Pat. No. 9,702,680, which is a division of application No. 14/904,788, filed as application No. PCT/CA2014/050673 on Jul. 16, 2014, now Pat. No. 9,494,021.

(51) Int. Cl.
*F42D 1/04* (2006.01)
*E21B 43/119* (2006.01)
*F42C 19/06* (2006.01)

(52) U.S. Cl.
CPC ..... *F42C 19/06* (2013.01); *F42D 1/02* (2013.01); *F42D 1/04* (2013.01); *F42D 1/043* (2013.01)

(58) Field of Classification Search
USPC ..... 89/1.5, 1.151; 166/297
See application file for complete search history.

(56) References Cited

U.S. PATENT DOCUMENTS 2,889,775 A 6/1959 Owen
2,906,339 A 9/1959 Griffin
3,040,659 A 6/1962 Mcculleugh
3,071,072 A 1/1963 Castel et al.
3,170,400 A 2/1965 Nelson
3,173,992 A 3/1965 Boop
3,211,093 A 10/1965 Mccullough et al.
3,246,707 A 4/1966 Bell
3,264,994 A 8/1966 Kurt
3,374,735 A 3/1968 Moore
3,504,723 A 4/1970 Cushman et al.
3,565,188 A 2/1971 Hakala
3,650,212 A 3/1972 Bauer
3,659,658 A 5/1972 Brieger
3,859,921 A 1/1975 Stephenson
4,007,790 A 2/1977 Henning
4,007,796 A 2/1977 Boop
4,058,061 A 11/1977 Mansur, Jr. et al.
4,107,453 A 8/1978 Erixon
4,140,188 A 2/1979 Vann
4,172,421 A 10/1979 Regalbuto
4,182,216 A 1/1980 DeCaro
4,191,265 A 3/1980 Bosse-Platiere
4,193,460 A 3/1980 Gilbert
4,266,613 A 5/1981 Boop
4,290,486 A 9/1981 Regalbuto
4,393,946 A 7/1983 Pottier et al.
4,485,741 A 12/1984 Moore et al.
4,491,185 A 1/1985 McClure
4,496,008 A 1/1985 Pottier et al.
4,512,418 A 4/1985 Regalbuto et al.
4,523,649 A 6/1985 Stout
4,523,650 A 6/1985 Sehnert et al.
4,534,423 A 8/1985 Regalbuto
4,541,486 A 9/1985 Wetzel et al.
4,574,892 A 3/1986 Grigar et al.
4,598,775 A 7/1986 Vann et al.
4,621,396 A 11/1986 Walker et al.
4,640,370 A 2/1987 Wetzel
4,650,009 A 3/1987 McClure et al.
4,655,138 A 4/1987 Regalbuto et al.
4,657,089 A 4/1987 Stout
4,744,424 A 5/1988 Lendermon et al.
4,747,201 A 5/1988 Donovan et al.
4,753,170 A 6/1988 Regalbuto et al.
4,753,301 A 6/1988 Berry
4,776,393 A 10/1988 Forehand et al.
4,790,383 A 12/1988 Savage et al.
4,800,815 A 1/1989 Appledorn et al.
4,852,494 A 8/1989 Williams
4,889,183 A 12/1989 Sommers et al.
5,006,833 A 4/1991 Marlowe et al.
5,027,708 A 7/1991 Gonzalez et al.
5,033,553 A 7/1991 Miszewski et al.
5,052,489 A 10/1991 Carisella et al.
5,060,573 A 10/1991 Montgomery et al.
5,088,413 A 2/1992 Huber et al.
5,105,742 A 4/1992 Sumner
5,159,145 A 10/1992 Carisella et al.
5,159,146 A 10/1992 Carisella et al.
5,241,891 A * 9/1993 Hayes ..... E21B 43/117 175/4.6
5,322,019 A 6/1994 Hyland
5,347,929 A 9/1994 Lerche et al.
5,358,418 A 10/1994 Carmichael
5,392,860 A 2/1995 Ross
5,436,791 A 7/1995 Furano et al.
5,603,384 A 2/1997 Bethel et al.
5,673,760 A 10/1997 Brooks et al.
5,703,319 A 12/1997 Fritz et al.
5,775,426 A 7/1998 Snider et al.
5,816,343 A 10/1998 Markel et al.
5,992,289 A 11/1999 George et al.
6,006,833 A 12/1999 Burleson et al.
6,012,525 A 1/2000 Burleson et al.
6,085,659 A 7/2000 Beukes et al.
6,112,666 A 9/2000 Murray et al.
6,263,283 B1 7/2001 Snider et al.
6,298,915 B1 10/2001 George
6,305,287 B1 10/2001 Capers et al.
6,333,699 B1 12/2001 Zierolf
6,354,374 B1 3/2002 Edwards et al.
6,385,031 B1 5/2002 Lerche et al.
6,408,758 B1 6/2002 Duguet
6,412,388 B1 7/2002 Frazier
6,418,853 B1 7/2002 Duguet et al.
6,419,044 B1 7/2002 Tite et al.
6,497,285 B2 12/2002 Walker
6,591,911 B1 7/2003 Markel et al.
6,595,290 B2 7/2003 George et al.
6,651,747 B2 11/2003 Chen et al.
6,702,009 B1 3/2004 Drury et al.
6,719,061 B2 4/2004 Muller et al.
6,739,265 B1 5/2004 Badger et al.
6,742,602 B2 6/2004 Trotechaud
6,752,083 B1 6/2004 Lerche et al.
6,773,312 B2 8/2004 Bauer et al.
6,779,605 B2 8/2004 Jackson
6,843,317 B2 1/2005 Mackenzie
6,942,033 B2 9/2005 Brooks et al.
7,013,977 B2 3/2006 Nordaas
7,044,230 B2 5/2006 Starr et al.
7,093,664 B2 8/2006 Todd et al.
7,107,908 B2 9/2006 Forman et al.
7,168,494 B2 1/2007 Starr et al.
7,193,527 B2 3/2007 Hall et al.
7,243,722 B2 7/2007 Oosterling et al.
7,278,491 B2 10/2007 Scott
7,347,278 B2 3/2008 Lerche et al.
7,347,279 B2 3/2008 Li et al.
7,353,879 B2 4/2008 Todd et al.
7,357,083 B2 4/2008 Takahara et al.
7,387,162 B2 6/2008 Mooney, Jr. et al.
7,441,601 B2 10/2008 George et al.
7,493,945 B2 2/2009 Doane et al.
7,510,017 B2 3/2009 Howell et al.
7,568,429 B2 8/2009 Hummel et al.
7,591,212 B2 9/2009 Myers, Jr. et al.
7,735,578 B2 6/2010 Loehr et al.
7,752,971 B2 7/2010 Loehr
7,762,172 B2 7/2010 Li et al.
7,762,331 B2 7/2010 Goodman et al.
7,762,351 B2 7/2010 Vidal
7,775,279 B2 8/2010 Marya et al.
7,778,006 B2 8/2010 Stewart et al.
7,810,430 B2 10/2010 Chan et al.
7,908,970 B1 3/2011 Jakaboski et al.
7,929,270 B2 4/2011 Hummel et al.
8,028,624 B2 10/2011 Mattson
8,066,083 B2 11/2011 Hales et al.

(56) References Cited

U.S. PATENT DOCUMENTS

| | | | |
|---|---|---|---|
| 8,069,789 | B2 | 12/2011 | Hummel et al. |
| 8,074,737 | B2 | 12/2011 | Hill et al. |
| 8,091,477 | B2 | 1/2012 | Brooks et al. |
| 8,127,846 | B2 | 3/2012 | Hill et al. |
| 8,127,848 | B2 | 3/2012 | Myers, Jr. et al. |
| 8,136,439 | B2 | 3/2012 | Bell |
| 8,141,434 | B2 | 3/2012 | Kippersund et al. |
| 8,151,882 | B2 | 4/2012 | Grigar et al. |
| 8,157,022 | B2 | 4/2012 | Bertoja et al. |
| 8,181,718 | B2 | 5/2012 | Burleson et al. |
| 8,182,212 | B2 | 5/2012 | Parcell |
| 8,186,259 | B2 | 5/2012 | Burleson et al. |
| 8,256,337 | B2 | 9/2012 | Hill et al. |
| 8,388,374 | B2 | 3/2013 | Grek et al. |
| 8,395,878 | B2 | 3/2013 | Stewart et al. |
| 8,413,727 | B2 | 4/2013 | Holmes |
| 8,439,114 | B2 | 5/2013 | Parrott et al. |
| 8,451,137 | B2 | 5/2013 | Bonavides et al. |
| 8,596,378 | B2 | 12/2013 | Mason et al. |
| 8,661,978 | B2 | 3/2014 | Backhus et al. |
| 8,678,666 | B2 | 3/2014 | Scadden et al. |
| 8,695,506 | B2 | 4/2014 | Lanclos |
| 8,807,003 | B2 | 8/2014 | Le et al. |
| 8,833,441 | B2 | 9/2014 | Fielder et al. |
| 8,863,665 | B2 | 10/2014 | DeVries et al. |
| 8,875,787 | B2 | 11/2014 | Tassoroli |
| 8,881,816 | B2 | 11/2014 | Glenn et al. |
| 8,943,943 | B2 | 2/2015 | Tassaroli |
| 9,080,433 | B2 | 7/2015 | Lanclos et al. |
| 9,145,764 | B2 | 9/2015 | Burton et al. |
| 9,181,790 | B2 | 11/2015 | Mace et al. |
| 9,206,675 | B2 | 12/2015 | Hales et al. |
| 9,284,824 | B2 | 3/2016 | Fadul et al. |
| 9,317,038 | B2 | 4/2016 | Ozick et al. |
| 9,359,863 | B2 | 6/2016 | Streich et al. |
| 9,383,237 | B2 | 7/2016 | Wiklund et al. |
| 9,494,021 | B2 | 11/2016 | Parks et al. |
| 9,523,265 | B2 | 12/2016 | Upchurch et al. |
| 9,581,422 | B2 | 2/2017 | Preiss et al. |
| 9,605,937 | B2 | 3/2017 | Eitschberger et al. |
| 9,677,363 | B2 | 6/2017 | Schacherer et al. |
| 9,689,223 | B2 | 6/2017 | Schacherer et al. |
| 9,702,211 | B2 | 7/2017 | Tinnen |
| 10,077,626 | B2 | 9/2018 | Xu et al. |
| 10,077,641 | B2 | 9/2018 | Rogman et al. |
| 10,190,398 | B2 | 1/2019 | Goodman et al. |
| D873,373 | S | 1/2020 | Hartman et al. |
| 10,731,443 | B2 | 8/2020 | Kaenel et al. |
| 2002/0020320 | A1 | 2/2002 | Lebaudy et al. |
| 2002/0062991 | A1 | 5/2002 | Farrant et al. |
| 2003/0000411 | A1 | 1/2003 | Cernocky et al. |
| 2003/0001753 | A1 | 1/2003 | Cernocky et al. |
| 2004/0141279 | A1 | 7/2004 | Amano et al. |
| 2005/0178282 | A1 | 8/2005 | Brooks et al. |
| 2005/0194146 | A1 | 9/2005 | Barker et al. |
| 2005/0229805 | A1 | 10/2005 | Myers, Jr. et al. |
| 2007/0084336 | A1 | 4/2007 | Neves |
| 2007/0119327 | A1 | 5/2007 | Myers et al. |
| 2007/0125540 | A1 | 6/2007 | Gerez et al. |
| 2007/0158071 | A1 | 7/2007 | Mooney et al. |
| 2008/0047456 | A1 | 2/2008 | Li et al. |
| 2008/0047716 | A1 | 2/2008 | McKee et al. |
| 2008/0110612 | A1 | 5/2008 | Prinz et al. |
| 2008/0134922 | A1 | 6/2008 | Grattan et al. |
| 2008/0149338 | A1 | 6/2008 | Goodman et al. |
| 2008/0173204 | A1 | 7/2008 | Anderson et al. |
| 2008/0264639 | A1 | 10/2008 | Parrott et al. |
| 2009/0050322 | A1 | 2/2009 | Hill et al. |
| 2009/0159285 | A1 | 6/2009 | Goodman |
| 2009/0272519 | A1 | 11/2009 | Green et al. |
| 2009/0272529 | A1 | 11/2009 | Crawford |
| 2010/0000789 | A1 | 1/2010 | Barton et al. |
| 2010/0089643 | A1 | 4/2010 | Vidal |
| 2010/0096131 | A1 | 4/2010 | Hill et al. |
| 2010/0107917 | A1 | 5/2010 | Moser |
| 2010/0163224 | A1 | 7/2010 | Strickland |
| 2010/0230104 | A1 | 9/2010 | Nölke et al. |
| 2011/0024116 | A1 | 2/2011 | McCann et al. |
| 2011/0042069 | A1 | 2/2011 | Bailey et al. |
| 2012/0006217 | A1 | 1/2012 | Anderson |
| 2012/0085538 | A1 | 4/2012 | Guerrero et al. |
| 2012/0094553 | A1 | 4/2012 | Fujiwara et al. |
| 2012/0160483 | A1 | 6/2012 | Carisella |
| 2012/0199031 | A1 | 8/2012 | Lanclos |
| 2012/0199352 | A1 | 8/2012 | Lanclos et al. |
| 2012/0241169 | A1 | 9/2012 | Hales et al. |
| 2012/0242135 | A1 | 9/2012 | Thomson et al. |
| 2012/0247769 | A1 | 10/2012 | Schacherer et al. |
| 2012/0247771 | A1 | 10/2012 | Black et al. |
| 2012/0298361 | A1 | 11/2012 | Sampson |
| 2013/0008639 | A1 | 1/2013 | Tassaroli |
| 2013/0008669 | A1 | 1/2013 | Deere et al. |
| 2013/0043074 | A1 | 2/2013 | Tassaroli |
| 2013/0062055 | A1 | 3/2013 | Tolman et al. |
| 2013/0118342 | A1 | 5/2013 | Tassaroli |
| 2013/0248174 | A1 | 9/2013 | Dale et al. |
| 2014/0033939 | A1 | 2/2014 | Priess et al. |
| 2014/0053750 | A1 | 2/2014 | Lownds et al. |
| 2014/0131035 | A1 | 5/2014 | Entchev et al. |
| 2015/0226044 | A1 | 8/2015 | Ursi et al. |
| 2015/0330192 | A1 | 11/2015 | Rogman et al. |
| 2016/0061572 | A1 | 3/2016 | Eitschberger et al. |
| 2016/0084048 | A1 | 3/2016 | Harrigan et al. |
| 2016/0168961 | A1 | 6/2016 | Parks et al. |
| 2017/0030693 | A1 | 2/2017 | Preiss et al. |
| 2017/0211363 | A1 | 7/2017 | Bradley et al. |
| 2017/0276465 | A1 | 9/2017 | Parks et al. |
| 2017/0298716 | A1 | 10/2017 | McConnell et al. |
| 2018/0202789 | A1 | 7/2018 | Parks et al. |
| 2020/0199983 | A1 | 6/2020 | Preiss et al. |

FOREIGN PATENT DOCUMENTS

| | | | |
|---|---|---|---|
| CN | 85107897 | A | 9/1986 |
| CN | 2661919 | | 12/2004 |
| CN | 2821154 | | 9/2006 |
| CN | 101397890 | A | 4/2009 |
| CN | 101454635 | A | 6/2009 |
| CN | 101691837 | B | 4/2010 |
| CN | 201620848 | U | 11/2010 |
| CN | 201764910 | U | 3/2011 |
| CN | 102878877 | A | 1/2013 |
| CN | 103993861 | A | 8/2014 |
| CN | 204200197 | U | 3/2015 |
| CN | 208280947 | U | 12/2018 |
| DE | 102007007498 | | 10/2015 |
| EP | 0180520 | B1 | 5/1991 |
| GB | 2404291 | A | 1/2005 |
| JP | 2003329399 | A | 11/2003 |
| RU | 2295694 | C2 | 3/2007 |
| RU | 93521 | U1 | 4/2010 |
| RU | 100552 | U1 | 12/2010 |
| RU | 2434122 | C2 | 11/2011 |
| RU | 2633904 | C1 | 10/2017 |
| WO | 2001059401 | A1 | 8/2001 |
| WO | WO-0159401 | A1 | 8/2001 |
| WO | 2008067771 | A1 | 6/2008 |
| WO | WO-2009091422 | A2 | 7/2009 |
| WO | 2009091422 | A3 | 3/2010 |
| WO | 2015006869 | A1 | 1/2015 |
| WO | 2015134719 | A1 | 9/2015 |
| WO | 2016037122 | A1 | 3/2016 |
| WO | 2016100269 | A1 | 6/2016 |
| WO | 2019009735 | A1 | 1/2019 |
| WO | 2019148009 | A2 | 8/2019 |

OTHER PUBLICATIONS

Amit Govil, Selective Perforation: A Game Changer in Perforating Technology—Case Study, presented at the 2012 European and West African Perforating Symposium, 14 pgs.

International Written Opinion of International Application No. PCT/CA2014/050673, dated Sep. 24, 2014, 4 pgs.

(56) References Cited

OTHER PUBLICATIONS

International Search Report of International Application No. PCT/CA2014/050673, dated Oct. 9, 2014, 3 pgs.
UK Examination Report of United Kingdom Patent Application No. GB1600085.3, dated Mar. 9, 2016, 1 pg.
SIPO, Search Report dated Mar. 29, 2017, in Chinese: See Search Report for CN App. No. 201480040456.9, which is in the same family as PCT App. No. PCT/CA2014/050673, 15 pgs.
World Intellectual Property Office, Search Report for GB Patent App. No. GB1700625.5, which is in the same family as PCT App No. PCT/CA2014/050673, dated Jul. 7, 2017, 5 pages.
Norwegan Industrial Property Office, Office Action for NO Patent App. No. 20160017, which is in the same family as PCT App No. PCT/CA2014/050673, dated Jun. 15, 2017, 3 pgs.
Norwegan Industrial Property Office, Search Report for NO Patent App. No. 20160017, which is in the same family as PCT App No. PCT/CA2014/050673, dated Jun. 15, 2017, 2 pgs.
FIIP, Search Report dated Feb. 1, 2018, in Russian: See Search Report for RU App. No. 2016104882/03, which is in the same family as PCT App. No. PCT/CA2014/050673, 11 pgs.
GB Intellectual Property Office, Office Action dated Feb. 27, 2018, See Office Action for App. No. GB 1717516.7, which is the same family as PCT App. No. PCT/CA2014/050673, 6 pg.
United States Patent and Trademark Office, Office Action of U.S. Appl. No. 16/585,790, which is in the same family as U.S. Appl. No. 15/920,812, dated Nov. 12, 2019, 9 pgs.
United States Patent and Trademark Office, Office Action of U.S. Appl. No. 16/455,816, in which U.S. Pat. No. 2,418,486 is cited, dated Nov. 5, 2019, 17 pgs.
United States Patent and Trademark Office, Office Action of U.S. Appl. No. 16/451,440, in which U.S. Pat. No. 5,992,289 is cited, dated Oct. 24, 2019, 22 pgs.
European Patent Office, International Search Report and Written Opinion of International Application No. PCT/EP2019/069165, in which U.S. Pat. No. 4,191,265 is cited, dated Oct. 22, 2019, 13 pgs.
Norwegian Industrial Property Office, Office Action for NO Patent App. No. 20171759, which is in the same family as U.S. Appl. No. 15/920,812, dated Jan. 14, 2020, 4 pgs.
Norwegian Industrial Property Office, Search Report for NO Patent App. No. 20171759, which is in the same family as U.S. Appl. No. 15/920,812, dated Jan. 14, 2020, 2 pgs.
United States Patent and Trademark Office, Case IPR2018-00600 for U.S. Pat. No. 9,581,422 B2, Order Granting Precedential Opinion Panel, Paper No. 46, dated Nov. 7, 2019,4 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019,23 pgs.
IPR2018-00600, Exhibit 3001, Patent Owner's Precedential Opinion Panel Request Letter in regard to Case IPR2018-00600 for U.S. Pat. No. 9,581,422 B2, dated Sep. 18, 2019, 2 pg.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of Patent No. 9,581,422, dated Mar. 7, 2019, 44 pgs.
United States Patent and Trademark Office, Case IPR2018-00600 for U.S. Pat. No. 9,581,422 B2, Reply in Support of Patent Owner's Motion to Amend, dated Mar. 21, 2019, 15 pgs.
Owen Oil Tools, Recommended Practice for Oilfield Explosive Safety, Presented at 2011 MENAPS Middle East and North Africa Perforating Symposium, Nov. 28-30, 2011, 6 pages.
Schlumberger, Combining and Customizing Technologies for Perforating Horizontal Wells in Algeria, Presented al 2011 MENAPS Middle East and North Africa Perforating Symposium, Nov. 28-30, 2011, 20 pages.
Austin Powder Company, A-140 F & Block, Detonator & Block Assembly, 2 pgs.
Owen Oil Tools & Pacific Scientific; Side Block for Side Initiation, 1 pg.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Baker Hughes, Long Gun Deployment Systems IPS-12-28, Presented at 2012 International Perforating Symposium, Apr. 26-28, 2011, 11 pages.
Jet Research Center Inc., JRC Catalog, 36 pgs., www.jetresearch.com.
Smylie, New Safe and Secure Detonators for the Industry's consideration, Presented at Explosives Safety & Security Conference Marathon Oil Co, Houston, Feb. 23-24, 2005, 20 pages.
Jet Research Center Inc., Red RF Safe Detonators Brochure, 2008, 2 pgs., www.jetresearch.com.
United States Patent and Trademark Office, Office Action of U.S. Appl. No. 16/540,484, dated Oct. 4, 2019, 12 pgs.
United States Patent and Trademark Office, Office Action of U.S. Appl. No. 16/809,729, dated Jun. 19, 2020, 9 pgs.
United States Patent and Trademark Office, Office Action of U.S. Appl. No. 29/733,080, dated Jun. 26, 2020, 8 pgs.
United States Patent and Trademark Office; Notice of Allowance for U.S. Appl. No. 16/387,696; dated Jan. 29, 2020; 7 pages.
USPTO; Notice of Allowance for U.S. Appl. No. 14/904,788; dated Jul. 6, 2016; 8 pages.
USPTO; Supplemental Notice of Allowability for U.S. Appl. No. 14/904,788; dated Jul. 21, 2016; 2 pages.
DynaEnergetics, Electronic Top Fire Detonator, Product Information Sheet, Jul. 30, 2013, 1 pg.
Brazilian Patent and Trademark Office; Search Report for BR Application No. BR112015033010-0; dated May 5, 2020; (4 pages).
Canadian Intellectual Property Office; Notice of Allowance for CA Appl. No. 2,821,506; dated Jul. 31, 2019; 1 page.
Canadian Intellectual Property Office; Office Action for CA Appl. No. 2,821,506; dated Mar. 21, 2019; 4 pages.
Dalia Abdallah et al., Casing Corrosion Measurement to Extend Asset Life, Dec. 31, 2013, 14 pgs., https://www.slb.com/-/media/files/oilfield-review/2-casing-corr-2-english.
DynaEnerget GMBH & CO. KG, Patent Owner's Response to Hunting Titan's Petition for Inter Parties Review—Case IPR2018-00600, filed Dec. 6, 2018, 73 pages.
DynaEnergetics; DynaStage Solution—Factory Assembled Performance-Assured Perforating Systems; 6 pages.
EP Patent Office—International Searching Authority, PCT Search Report and Written Opinion for PCT Application No. PCT/EP2014/065752, dated May 4, 2015, 12 pgs.
Eric H. Findlay, Jury Trial Demand in Civil Action No. 6:20-cv-00069-ADA, dated Apr. 22, 2020, 32 pages.

(56) References Cited

OTHER PUBLICATIONS

European Patent Office; Invitation to Correct Deficiencies noted in the Written Opinion for European App. No. 15721178.0; dated Dec. 13, 2016; 2 pages.
European Patent Office; Office Action for EP App. No. 15721178.0; dated Sep. 6, 2018; 5 pages.
Federal Institute of Industrial Property; Decision of Granting for RU Appl. No. 2016104882/03(007851); dated May 17, 2018; 15 pages (English translation 4 pages).
Federal Institute of Industrial Property; Decision on Granting a Patent for Invention Russian App. No 2016139136/03(062394); dated Nov. 8, 2018; 20 pages (Eng Translation 4 pages); Concise Statement of Relevance: Search Report at 17-18 of Russian-language document lists several 'A' references based on RU application claims.
Federal Institute of Industrial Property; Inquiry for RU App. No. 2016104882/03(007851); dated Feb. 1, 2018; 7 pages, English Translation 4 pages.
Federal Institute of Industrial Property; Inquiry for RU Application No. 2016110014/03(015803); issued Feb. 1, 2018; 6 pages (Eng. Translation 4 pages).
GB Intellectual Property Office; Examination Report for GB Appl. No. 1717516.7; dated Apr. 13, 2018; 3 pages.
GB Intellectual Property Office; Notification of Grant for GB Appl. No. 1717516.7;dated Oct. 9, 2018; 2 pages.
GB Intellectual Property Office; Search Report for GB. Appl. No. 1700625.5; dated Dec. 21, 2017; 5 pages.
Hunting Titan Inc., Petition for Inter Parties Review of U.S. Pat. No. 9,581,422, filed Feb. 16, 2018, 93 pgs.
Industrial Property Office, Czech Republic; Office Action for CZ App. No. PV 2017-675; Jul. 18, 2018; 2 pages; Concise Statement of Relevance: Examiner's objection of CZ application claims 1, 7, and 16 based on US Pub No. 20050194146 alone or in combination with WO Pub No. 2001059401.
Industrial Property Office, Czech Republic; Office Action for CZ App. No. PV 2017-675; dated Oct. 26, 2018; 2 pages.
Industrial Property Office, Czech Republic; Office Action; CZ App. No. PV 2017-675; dated Dec. 17, 2018; 2 pages.
International Searching Authority, International Preliminary Report on Patentability for PCT App. No. PCT/EP2014/065752; dated Mar. 1, 2016,10 pgs.
International Searching Authority; International Preliminary Report on Patentability for PCT Appl. No. PCT/CA2014/050673; dated Jan. 19, 2016; 5 pages.
International Searching Authority; International Search Report and Written Opinion for PCT App. No. PCT/EP2015/059381; dated Nov. 23, 2015; 14 pages.
International Searching Authority; International Search Report and Written Opinion for PCT App. No. PCT/US2015/018906; dated Jul. 10, 2015; 12 pages.
Jet Research Centers, Capsule Gun Perforating Systems, Alvarado, Texas, 26 pgs., https://www.jetresearch.com/content/dam/jrc/Documents/Books_Catalogs/07_Cap_Gun.pdf.
McNelis et al.; High-Performance Plug-and-Perf Completions in Unconventional Wells; Society of Petroleum Engineers Annual Technical Conference and Exhibition; Sep. 28, 2015.
Norwegian Industrial Property Office; Office Action for NO Appl. No. 20160017; dated Dec. 4, 2017; 2 pages.
Norwegian Industrial Property Office; Opinion for NO Appl. No. 20171759; dated Apr. 5, 2019; 1 page.
Robert Parrott, Case IPR2018-00600 for U.S. Pat. No. 9,581,422 B2, Declaration regarding Patent Invalidity, dated Jun. 29, 2020, 146 pages.
State Intellectual Property Office People's Republic of China; First Office Action for Chinese App. No. 201811156092.7; dated Jun. 16, 2020; 6 pages (Eng Translation 8 pages).
State Intellectual Property Office, P.R. China; First Office Action for Chinese App No. 201580011132.7; dated Jun. 27, 2018; 5 pages (Eng. Translation 9 pages).
State Intellectual Property Office, P.R. China; First Office Action for CN App. No. 201480047092.7; dated Apr. 24, 2017.
State Intellectual Property Office, P.R. China; First Office Action with full translation for CN App. No. 201480040456.9; dated Mar. 29, 2017; 12 pages (English translation 17 pages).
State Intellectual Property Office, P.R. China; Notification to Grant Patent Right for Chinese App. No. 201580011132.7; dated Apr. 3, 2019; 2 pages (Eng. Translation 2 pages).
State Intellectual Property Office, P.R. China; Notification to Grant Patent Right for CN App. No. 201480040456.9; Jun. 12, 2018; 2 pages (English translation 2 pages).
State Intellectual Property Office, P.R. China; Second Office Action for CN App. No. 201480040456.9 dated Nov. 29, 2017; 5 pages (English translation 1 page).
State Intellectual Property Office, P.R. China; Second Office Action for CN App. No. 201480047092.7 dated Jan. 4, 2018; 3 pages.
U.S. Patent Trial and Appeal Board, Institution of Inter Partes Review of U.S. Pat. No. 9,581,422, Case IPR2018-00600,Aug. 21, 2018, 9 pages.
United States Patent and Trademark Office, Case IPR2018-00600 for U.S. Pat. No. 9,581,422 B2, Patent Owner's Decision, Granting Patent Owner's Request for Hearing and Granting Patent Owner's Motion to Amend, dated Jul. 6, 2020, 27 pgs.
United States Patent and Trademark Office, Case PGR 2020-00072 for U.S. Pat. No. 10,429,161 B2, Petition for Post Grant Review of Claims 1-20 of U.S. Pat. No. 10,429,161 Under 35 U.S.C. §§ 321-28 and 37 C.F.R. §§42.200 ET SEQ., dated Jun. 30, 2020, 109 pages.
United States Patent and Trademark Office, Office Action of U.S. Appl. No. 14/767,058, dated Jul. 15, 2016, 9 pgs.
United States Patent and Trademark Office, Office Action of U.S. Appl. No. 15/117,228, dated May 31, 2018, 9 pgs.
United States Patent and Trademark Office, Office Action of U.S. Appl. No. 15/617,344, dated Jan. 23, 2019, 5 pgs.
United States Patent and Trademark Office, Office Action of U.S. Appl. No. 15/788,367, dated Oct. 22, 2018, 6 pgs.
United States Patent and Trademark Office, Office Action of U.S. Appl. No. 15/920,800, dated Dec. 27, 2019, 6 pgs.
United States Patent and Trademark Office, Office Action of U.S. Appl. No. 16/026,431, dated Jul. 30, 2019, 10 pgs.
United States Patent and Trademark Office, Office Action of U.S. Appl. No. 16/359,540, dated Aug. 14, 2019, 9 pgs.
United States Patent and Trademark Office, Office Action of U.S. Appl. No. 16/359,540, dated May 3, 2019, 11 pgs.
Baker Hughes, SurePerf Rapid Select-Fire System, Perforate production zones in a single run, Sep. 2012, 2 pgs., www.bakerhughes.com.
DynaEnergetics, DYNASelect System, information downloaded from website, http://www.dynaenergetics.com/, dated Jul. 3, 2013, 2 pgs.
GILLIAT/GASMI, New Select-Fire System, Baker Hughes, Presentation—2013 Asia-Pacific Perforating Symposium, Apr. 29, 2013 ,16 pgs., http://www.perforators.org/presentations.php.
DynaEnergetics, DYNAselect Electronic Detonator 0015 SFDE RDX 1.4S, Product Information, Dec. 16, 2011, 1 pg.
DynaEnergetics, DYNAselect Electronic Detonator 0015 SFDE RDX 1.4B, Product Information,Dec. 16, 2011, 1 pg.
DynaEnergetics, Gun Assembly, Products Summary Sheet, dated May 7, 2004, 1 pg.
DynaEnergetics, Selective Perforating Switch, Product Information Sheet, May 27, 2011, 1 pg.
DynaEnergetics, Selective Perforating Switch, Product Summary—from website, http:www.dynaenergetics.com/, Jul. 3, 2013, 2 pgs.
German Patent Office, Office Action for DE Patent Appl. No. 10 2013 109 227.6, which is in the same family as U.S. pat. No. 9,581,422-B2, May 22, 2014, p. 5—list of references cited, 8 pgs.
WIPO, PCT Search Report and Written Opinion for International Application No. PCT/EP2014/065752, which is in the same family as U.S. Pat. No. 9,581,422-B2, May 4, 2015, 12 pgs.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
United States Patent and Trademark Office, Non Final Office Action of U.S. Appl. No. 16/540,484, dated Aug. 20, 2020, 10 pgs.

(56) References Cited

OTHER PUBLICATIONS

Parrott, Robert et al.; U.S. Appl. No. 60/286,907; dated Apr. 27, 2001; 24 pages.
Parrott, Robert et al.; U.S. Appl. No. 60/306,938; dated Jul. 20, 2001; 26 pages.
Parrott, Robert; Declaration for PGR No. 2021-00078; dated May 10, 2021; 182 pages.
Parrott, Robert; U.S. Appl. No. 60/307,086; dated Jul. 20, 2001; 15 pages.
Perf.com VaporGun; Exhibit No. 1021 of PGR No. 2021-00089; dated Aug. 6, 2020; http://www.perf.com/vaporgun 4 pages.
Perforating Guns and Setting Tools; Exhibit 1015 of PGR No. 2021-00089; dated Dec. 2019; 33 pages.
Perforating Services Catalog 2008 part 1 of 2; Exhibit 1020 of PGR No. 2021-00089 dated 2008; 282 pages.
Perforating Services Catalog 2008 part 2 of 2; Exhibit 1020 of PGR No. 2021-00089; dated 2008; 239 pages.
Preiss Frank et al.; Lowering Total Cost of Operations Through Higher Perforating Efficiency while simultaneously enhancing safety; 26 pages.
Resilience Against Market Volatility Results Presentation; Exhibit 2015 of PGR No. 2020-00080; dated Jun. 30, 2020; 26 pages.
Rodgers, John; Declaration for PGR2020-00072; dated Oct. 23, 2020; 116 pages.
Rodgers, John; Declaration for PGR2020-00080; dated Nov. 18, 2020; 142 pages.
Salt Warren et al.; New Perforating Gun System Increases Safety and Efficiency; dated Apr. 1, 2016; 11 pages.
Scharf Thilo; Declaration for PGR2020-00080; dated Nov. 16, 2020; 16 pages.
Scharf, Thilo; Declaration for PGR2020-00072; dated Oct. 22, 2020; 13 pages.
Schlumberger Technology Corporation; Petiton for Post Grant Review Case No. PGR2021-00089; dated Jun. 1, 2021; 155 pages.
Select Fire System; Exhibit 1028 of PGR 2021-00078; dated 2012; 165 pages.
Sharma, Gaurav; Hunting Plc Is Not in a Race to the Bottom, Says Oilfield Services Firm's CEO; dated Sep. 10, 2019; retrieved on Nov. 18, 2020; 6 pages.
Southern District of Texas; Discovery Order for Civil Action No. 3:20-cv-000376; dated Mar. 12, 2021; 6 pages.
Stifel; Why the Big Pause? Balancing Long-Term Value with Near-Term Headwinds. Initiating Coverage of Oilfield Svcs and Equipment; dated Sep. 10, 2018; 207 pages.
United States Patent and Trademark Office, U.S. Pat. No. 10,429,161; 263 pages.
United States Patent and Trademark Office, U.S. Pat. No. 10,472,938; 485 pages.
United States Patent and Trademark Office, Notice of Allowance for U.S. Appl. No. 15/920,800, dated Jul. 7, 2020, 7 pgs.
United States Patent and Trademark Office, Notice of Allowance for U.S. Appl. No. 16/585,790, dated Jun. 19, 2020, 16 pgs.
United States Patent and Trademark Office, U.S. Appl. No. 61/733,129, filed Dec. 4, 2012; 10 pages.
United States Patent and Trademark Office, U.S. Appl. No. 61/819,196, filed May 3, 2013 ; 10 pages.
United States Patent and Trademark Office; Final Office Action of U.S. Appl. No. 16/809,729, dated November3, 2020; 19 pages.
United States Patent and Trademark Office; U.S. Pat. No. 10,844,696 part 1 of 5; dated Nov. 4, 2020; 402 pages.
United States Patent and Trademark Office; U.S. Pat. No. 10,844,696 part 2 of 5; dated Nov. 4, 2020; 301 pages.
United States Patent and Trademark Office; U.S. Pat. No. 10,844,696 part 3 of 5; dated Nov. 4, 2020; 408 pages.
United States Patent and Trademark Office; U.S. Pat. No. 10,844,696 part 4 of 5; dated Nov. 4, 2020; 375 pages.
United States Patent and Trademark Office; U.S. Pat. No. 10,844,696 part 5 of 5; dated Nov. 4, 2020; 303 pages.
United States Patent and Trademark Office; Non-Final Office Action for U.S. Appl. No. 17/007,574; dated Jan. 29, 2021; 11 pages.
United States Patent and Trademark Office; Non-Final Office Action of U.S. Appl. No. 15/920,800; dated Dec. 9, 2020; 6 pages.
United States Patent and Trademark Office; Notice of Allowance for U.S. Appl. No. 16/585,790, dated Aug. 5, 2020; 15 pages.
United States Patent and Trademark Office; Notice of Allowance for U.S. Appl. No. 16/511,495; dated Dec. 15, 2020; 9 pages.
United States Patent and Trademark Office; Notice of Allowance for U.S. Appl. No. 16/455,816; dated Sep. 22, 2020; 12 pages.
United States Patent and Trademark Office; Notice of Allowance for U.S. Appl. No. 16/809,729; dated Jan. 26, 2021; 9 pages.
United States Patent and Trademark Office; Notice of Allowance for U.S. Appl. No. 17/007,574; dated May 21, 2021; 8 pages.
United States Patent and Trademark Office; Patent Prosecution History of U.S. Appl. No. 16/585,790; dated Nov. 24, 2020; 1,066 pages.
United States Patent and Trademark Office; Patent Prosecution History of U.S. Appl. No. 61/733,129; dated Jan. 3, 2013; 22 pages.
United States Patent and Trademark Office; Patent Prosecution History U.S. Appl. No. 61/439,217; dated Mar. 4, 2011; 31 pages.
United States Patent and Trademark Office; U.S. Appl. No. 62/002,559; dated May 23, 2014; 19 pages.
United States Patent and Trademark Office; U.S. Appl. No. 62/002,565; dated Jun. 25, 2014; 25 pages.
United States Patent and Trademark Office; U.S. Appl. No. 62/014,900; dated Jul. 7, 2014; 25 pages.
United States Patent and Trademark Office; U.S. Appl. No. 62/015,014; dated Jul. 7, 2014; 21 pages.
United States Patent and Trademark Office; U.S. Appl. No. 62/015,030; dated Jul. 14, 2014; 29 pages.
United States Patent and Trademark Office; UU.S. Appl. No. 62/112,935; dated Feb. 6, 2015; 33 pages.
United States Patent and Trademark Office; U.S. Appl. No. 62/131,324; dated Mar. 24, 2015; 65 pages.
United States Patent and Trademark Office; U.S. Appl. No. 62/621,999; dated Jan. 25, 2018; 42 pages.
Alavi, Amir; Stipulation letter to Barry Herman; Exhibit 1026 of PGR No. 2021-00078 dated May 10, 2021; 2 pages.
Albright; Order Governing Proceedings—Patent Cases; Exhibit No. 1033 of PGR No. 2021-00089; 10 pages.
Bahr, Robert W.; Memorandum from Deputy Commissioner for Patent Examination Policy; dated Apr. 5, 2018; 7 pages.
Baumann et al.; Perforating Innovations—Shooting Holes in Performance Models; Oilfield Review, Autumn 2014, vol. 26, Issue No. 3 pp. 14-31; 18 pages.
Bear Manufacturing; Defendant Bear Manufacturing, LLC's Answer, Affirmative Defenses and Counterclaim in response to Plaintiffs' Complaint for Civil Action No. 3:21-cv-00185-M; dated Mar. 22, 2021; 14 pages.
Bohanek, et al.; The Efficiency of Liner Shaped Charges; dated Jun. 2014; 8 pages.
Buche & Associates, P.C.; Rule 501 Citation of Prior Art and Written "Claim Scope Statements" in U.S. Pat. No. 10,844,697; dated Mar. 3, 2021; 24 pages.
Coaxial Power Connector; Exhibit 1017 of PGR 2021-00078; dated Mar. 22, 2021; 9 pages.
Coil Spring; Exhibit 1024 of PGR No. 2021-00078; dated Apr. 2, 2021; 4 pages.
ControlFire RF-Safe Assembly Gun Loading Manual; Exhibit No. 2004 of PGR No. 2020-00072; 33 pages.
ControlFire User Manual; Exhibit No. 2005 of PGR No. 2020-00072; 2014; 56 pages.
Cooperative Patent Classification; Fixed Constructions Earth Drilling, Mining; dated Feb. 2021; 25 pages.
CoreLab Quick Change Assembly; Exhibit No. 1034 of PGR No. 2021-00078; dated Aug. 2002; 1 page.
Dyess, Adam; Declaration; dated May 30, 2021; 5 pages.
DynaEnergetics Europe GMBH; Patent Owner's Preliminary Response for PGR2020-00072; dated Oct. 23, 2020; 108 pages.
DynaEnergetics Europe GMBH; Patent Owner's Preliminary Response for PGR2020-00080; dated Nov. 18, 2020; 119 pages.
DynaEnergetics Europe; Defendants' Preliminary Infringement Contentions for Civil Action No. 3:20-CV-00376; dated Mar. 25, 2021; 22 pages.

(56) References Cited

OTHER PUBLICATIONS

DynaEnergetics Europe; DynaEnergetics Celebrates Grand Opening of DynaStage Manufacturing and Assembly Facilities in Blum, Texas; dated Nov. 16, 2018; 3 pages.
DynaEnergetics Europe; DynaEnergetics Europe GMBH and DynaEnergetics US, Inc.'s Answer to Complaint and Counterclaim Civil Action No. 3:20-cv-000376; dated Mar. 8, 2021; 23 pages.
DynaEnergetics Europe; Patent Owner's Preliminary Response for PGR No. 2020-00080; dated Nov. 18, 2020; 119 pages.
DynaEnergetics Europe; Petition to Correct Inventorship in Patent under 37 C.F.R § 1.324; dated Oct. 13, 2020; 21 pages.
DynaEnergetics exhibition and product briefing; Exhibit 2006 of PGR No. 2020-00072; dated 2013; 15 pages.
DynaStage Gun System; Exhibit 2009 of PGR No. 2020-00080; dated May 2014; 2 pages.
Electronic Patent Assignment System; Patent Assignment Cover Sheet for U.S. Appl. No. 13/331,596; dated Mar. 5, 2012; 8 pages.
Electronic Patent Assignment System; Patent Assignment Cover Sheet for U.S. Appl. No. 14/649,577; dated Sep. 21, 2015; 14 pages.
EQUAfrac Brochure; Exhibit No. 1016 of PGR No. 2021-00089; 6 pages.
EQUAfrac Shaped Charges; Exhibit No. 1018 of PGR No. 2021-00089; dated 2018; 2 pages.
G&H Diversified Manufacturing LP; Petition for Post Grant Review PGR No. 2021-00078; dated May 10, 2021; 122 pages.
Global Presence Hunting PLC—2014 Full Year Results; Exhibit No. 1019 of PGR No. 2021-00089; dated 2014; 30 pages.
Global Wireline Market; Exhibit 2010 of PGR 2020-00072; dated Oct. 15, 2019; 143 pages.
H-1 Perforating Gun System; Exhibit No. 1022 of PGR No. 2021-00089; dated May 1, 2020; 6 pages.
Halliburton; Wireline and Perforating Advances in Perforating; dated Nov. 2012; 12 pages.
Hunting Titan Gun System Catalog; Exhibit No. 1035 of PGR No. 2021-00078; 59 pages.
Hunting Titan Inc.; Petition for Post Grant Review of U.S. Pat. No. 10,472,938; dated Aug. 12, 2020; 198 pages.
Hunting Titan Ltd.; Defendants' Answer and Counterclaims, Civil Action No. 6:20-cv-00069; dated Mar. 17, 2020; 30 pages.
Hunting Titan Ltd.; Defendants' Answer to First Amended Complaint and Counterclaims, Civil Action No. 6:20-cv-00069; dated Apr. 6, 2020; 30 pages.
Hunting Titan Ltd.; Defendants' Answer to Second Amended Complaint and Counterclaims, Civil Action No. 6:20-cv-00069; dated May 12, 2020; 81 pages.
Hunting Titan; Response to Canadian Office Action for CA App. No. 2,933,756; dated Nov. 23, 2017; 18 pages.
Hunting Wireline Hardware Brochures; Exhibit No. 1025 of PGR No. 2021-00078; dated 2013; 27 pages.
International Searching Authority; International Preliminary Report on Patentability for PCT Application No. PCT/EP2019/069165; dated Jan. 28, 2021; 9 pages.
International Searching Authority; International Preliminary Report on Patentability for PCT Application No. PCT/IB2019/000569; dated Jan. 28, 2021; 8 pages.
International Searching Authority; International Search Report and Written Opinion of the International Searching Authority for PCT/EP2020/085624; dated Apr. 12, 2021; 11 pages.
International Searching Authority; International Search Report and Written Opinion of the International Searching Authority for PCT/EP2020/086496; dated Apr. 7, 2021; 10 pages.
Introduction to Seamless Pipe Manufacturing; Exhibit 1016 of PGR No. 2021-00078; 3 pages.
Isolation Sub Assembly; Exhibit No. 1027 of PGR No. 2021-00078; dated Mar. 2008; 5 pages.
Johnson, Bryce; Citation of Prior Art and Written Statements in Patent Files for U.S. Pat. No. 10,844,697; dated Apr. 29, 2021; 2 pages.
Johnson, Bryce; Rule 501 citation of prior art and written "claim scope statements" in U.S. Pat. No. 10,844,697; dated Apr. 29, 2021; 18 pages.
Marketing White Paper: EQUAfrac Shaped Charge; Exhibit 1017 of PGR No. 2021-00089; dated Jan. 2017; 5 pages.
Parrot, Robert; Declaration, PGR 2020-00080; dated Aug. 11, 2020; 400 pages.
Parrott, Robert A.; Declaration in Support of PGR20201-00089; dated Jun. 1, 2021; 353 pages.
United States Patent and Trademark Office; U.S. Appl. No. 62/627,591; dated Feb. 7, 2018; 40 pages.
United States Patent Trial and Appeal Board; Decision Denying Institution of Post-Grant Review; PGR No. 2020-00072; dated Jan. 19, 2021; 38 pages.
United States Patent Trial and Appeal Board; Institution Decision for PGR 2020-00080; dated Feb. 12, 2021; 15 pages.
Western District of Texas; Case Readiness Status Report for Civil Action No. 6:20-CV-01110-ADA; dated Mar. 25, 2021; 5 pages.
Western District of Texas; Order Governing Proceedings—Patent Case; dated Feb. 23, 2021; 10 pages.
Western District of Texas; Summons in a Civil Action Civil Action No. 6:20-cv-01110-ADA; dated Mar. 1, 2021; 3 pages.
World Oil; DynaEnergetics expands DynaStage factory-assembled, well perforating systems; dated Mar. 14, 2017; 2 pages.
Yang, Wenbo et al.; U.S. Appl. No. 60/314,200, filed Aug. 22, 2001; 15 pages.

* cited by examiner

FIG. 4
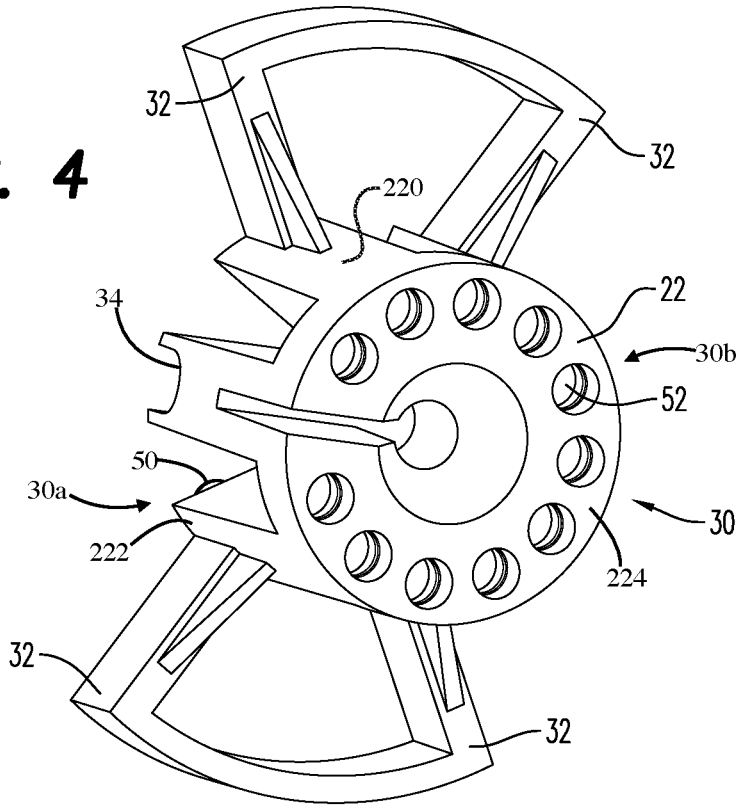
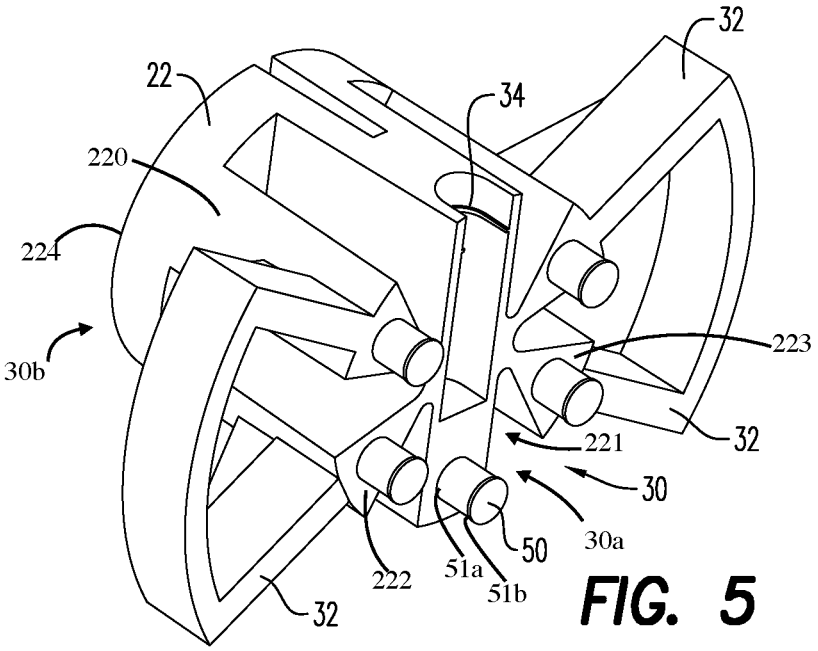
FIG. 5

FIG. 29
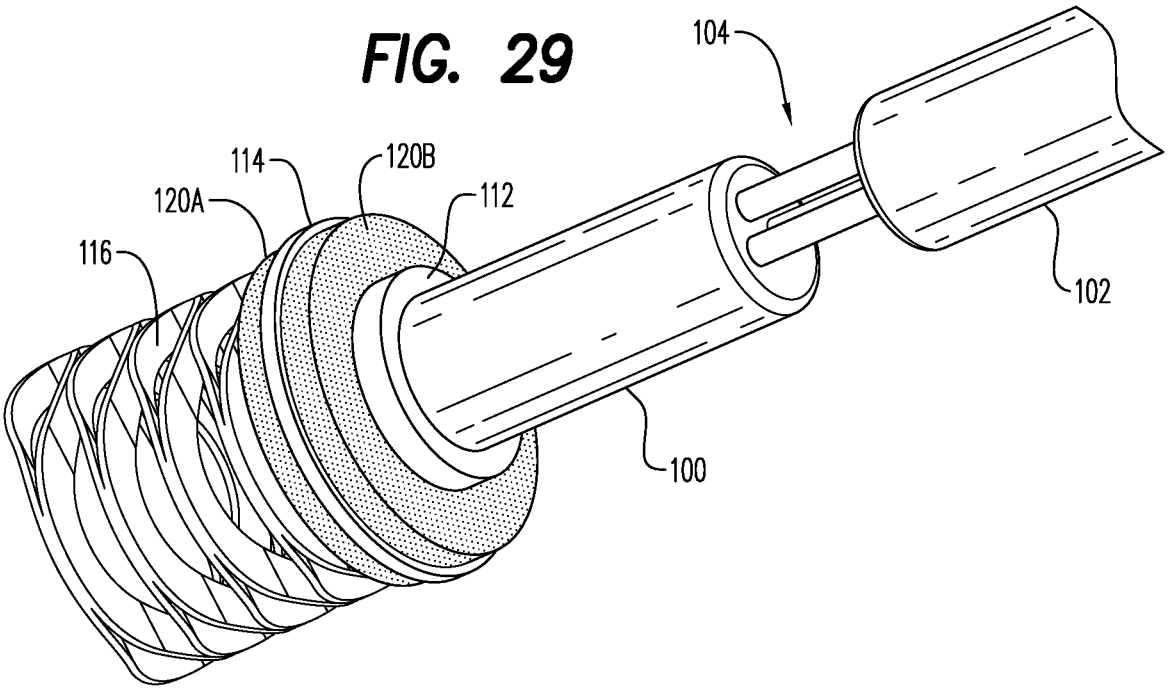
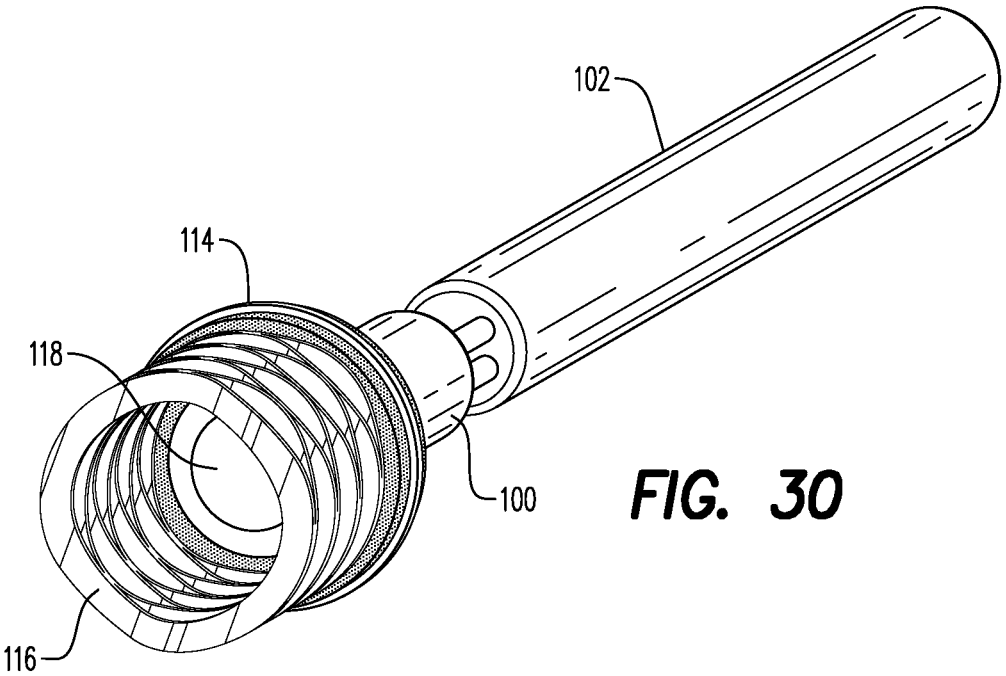
FIG. 30

PERFORATION GUN COMPONENTS AND SYSTEM

CROSS-REFERENCE TO RELATED APPLICATIONS

This application is a continuation of U.S. patent application Ser. No. 15/617,344 filed Jun. 8, 2017, which is a divisional patent application of U.S. patent application Ser. No. 15/287,309 filed Oct. 6, 2016, which is a divisional patent application of U.S. patent application Ser. No. 14/904,788 filed Jan. 13, 2016, which claims priority to PCT Application No. PCT/CA2014/050673 filed Jul. 16, 2014, which claims priority to Canadian Patent Application No. 2,821,506 filed Jul. 18, 2013, each of which is incorporated herein by reference in its entirety.

FIELD

A perforation gun system is generally described. More particularly, various perforation gun components that can be modularly assembled into a perforation gun system, the assembled perforated gun system itself, a perforation gun system kit, and a method for assembling a perforation gun system are generally described.

BACKGROUND

Perforation gun systems are used in well bore perforating in the oil and natural gas industries to tie a bore hole with a storage horizon within which a storage reservoir of oil or natural gas is located.

A typical perforation gun system consists of an outer gun carrier, arranged in the interior of which there are perforators—usually hollow or projectile charges—that shoot radially outwards through the gun carrier after detonation. Penetration holes remain in the gun carrier after the shot.

In order to initiate the perforators, there is a detonating cord leading through the gun carrier that is coupled to a detonator.

Different perforating scenarios often require different phasing and density of charges or gun lengths. Moreover, it is sometimes desirable that the perforators shooting radially outwards from the gun carrier be oriented in different directions along the length of the barrel. Therefore, phasing may be required between different guns along the length.

Onsite assembly of perforation gun systems may also be problematic under certain conditions as there are certain safety hazards inherent to the assembly of perforation guns due to the explosive nature of certain of its sub-components, including the detonator and the detonating cord.

There is thus a need for a perforation gun system, which by virtue of its design and components would be able to address at least one of the above-mentioned needs, or overcome or at least minimize at least one of the above-mentioned drawbacks.

SUMMARY

According to an embodiment, an object is to provide a perforation gun system that addresses at least one of the above-mentioned needs.

According to an embodiment, there is provided a perforation gun system having an outer gun carrier and comprising:

a top connector;

at least one stackable charge holder for centralizing a single shaped charge within the gun carrier;

a detonation cord connected to the top connector and to each stackable charge holder;

at least one bottom connector for terminating the detonation cord in the gun system; and a detonator energetically coupled to the detonation cord, wherein each of the top connector, at least one stackable charge holder and at least one bottom connector comprise a rotation coupling for providing a selectable clocking rotation between each of the top connector, at least one stackable charge holder and at least one bottom connector.

In some embodiments, the bottom connector may double as a spacer for spacing a plurality of stackable charge holders, and may either act as a metric dimensioned spacer or as an imperial dimensioned spacer for any specific metric or imperial shot density, phase and length gun system.

According to another aspect, there is also provided a perforation gun system kit having component parts capable of being assembled within an outer gun carrier, the kit comprising a combination of:

a top connector;

at least one stackable charge holder for centralizing a single shaped charge within the gun carrier;

a detonation cord connectable to the top connector and to each stackable charge holder;

at least one bottom connector adapted for terminating the detonation cord in the gun system; and a detonator energetically couplable to the detonation cord, wherein each of the top connector, at least one stackable charge holder and at least one bottom connector comprise a coupling having a plurality of rotational degrees of freedom for providing a selectable rotation between each of the top connector, at least one stackable charge holder and at least one bottom connector.

According to another aspect, there is also provided a method for assembling a perforation gun system, comprising the steps of:

providing a perforation gun system kit having component parts capable of being assembled within an outer gun carrier, the kit comprising a combination of:

a top connector;

at least one stackable charge holder for centralizing a single shaped charge within the gun carrier;

a detonation cord connectable to the top connector and to each stackable charge holder;

at least one bottom connector adapted for terminating the detonation cord in the gun system and adapted for doubling as a spacer for spacing a plurality of stackable charge holders; and a detonator energetically couplable to the detonation cord, wherein each of the top connector, at least one stackable charge holder and at least one bottom connector comprise a coupling having a plurality of rotational degrees of freedom for providing a selectable rotation between each of the top connector, at least one stackable charge holder and at least one bottom connector;

assembling a plurality of the stackable charge holders in a predetermined phase to form a first gun assembly;

running the detonation cord into a bottommost bottom connector;

assembling the bottommost bottom connector onto the assembled plurality of stackable charge holders;

running a through wire between the bottommost bottom connector and the top connector, so that the wire goes from the top connector to the bottom connector;

clicking the detonation cord into recesses formed in capturing projections, the captured projections being provided in each of the charge holders;

running the detonation cord into the top connector;

cutting the detonator cord; and installing charges into each of the charge holders.

A number of optional steps that are detailed below may be added to the above-described steps of the method.

According to another aspect, there is also provided a top connector for a perforation gun system comprising:

a coupler for providing energetic coupling between a detonator and a detonating cord;

at least one directional locking fin for locking the top connector within a gun carrier;

a rotation coupling for providing a selectable clocking rotation between the top connector, and a charge holder wherein the top connector is configured to receive electrical connections therethrough.

According to another aspect, there is also provided a stackable charge holder for a perforation gun system having an outer gun carrier, the charge holder comprising:

a charge receiving structure for receiving a single shaped charge;

a plurality of projections for centralizing the shaped charge within the gun carrier; and at least one rotation coupling for providing a selectable clocking rotation between the charge holder and an adjacent component in the perforation gun system;

wherein a pair of the plurality of projections is configured for capturing a detonation cord traversing the charge holder.

According to another aspect, there is also provided a bottom connector for a perforation gun system comprising:

a terminating structure arranged for terminating a detonation cord in the gun system;

a plurality of wings or fins for axially locking the bottom connector to a snap ring fixed in the carrier.

a rotation coupling for providing a selectable clocking rotation between the bottom connector and a charge holder;

wherein the rotation coupling is arranged such that bottom connector doubles as a spacer for spacing a plurality of stackable charge holders.

BRIEF DESCRIPTION OF THE DRAWINGS

These and other objects and advantages will become apparent upon reading the detailed description and upon referring to specific embodiments thereof that are illustrated in the appended drawings. Understanding that these drawings depict only typical embodiments and are not therefore to be considered to be limiting of its scope, exemplary embodiments will be described and explained with additional specificity and detail through the use of the accompanying drawings in which:

FIG. 4 is a front perspective view of a bottom connector in accordance with an embodiment;

FIG. 5 is a rear perspective view of the bottom connector shown in FIG. 4;

FIG. 29 is another detailed perspective view of the detonator shown in FIG. 27;

FIG. 30 is another detailed perspective view of the detonator shown in FIG. 27;

DETAILED DESCRIPTION

In the following description and accompanying FIGS., the same numerical references refer to similar elements throughout the FIGS. and text. Furthermore, for the sake of simplicity and clarity, namely so as not to unduly burden the FIGS. with several reference numbers, only certain FIGS. have been provided with reference numbers, and components and features of the embodiments illustrated in other FIGS. can be easily inferred therefrom. The embodiments, geometrical configurations, and/or dimensions shown in the FIGS. are for exemplification purposes only. Various features, aspects and advantages of the embodiments will become more apparent from the following detailed description.

Moreover, although some of the embodiments were primarily designed for well bore perforating, for example, they may also be used in other perforating scenarios or in other fields, as apparent to a person skilled in the art. For this reason, expressions such as "gun system", etc., as used herein should not be taken as to be limiting, and includes all other kinds of materials, objects and/or purposes with which the various embodiments could be used and may be useful. Each example or embodiment are provided by way of explanation, and is not meant as a limitation and does not constitute a definition of all possible embodiments.

In addition, although some of the embodiments are illustrated in the accompanying drawings comprise various components and although the embodiment of the adjustment system as shown consists of certain geometrical configurations as explained and illustrated herein, not all of these components and geometries are essential and thus should not be taken in their restrictive sense, i.e. should not be taken as to limit the scope. It is to be understood, as also apparent to a person skilled in the art, that other suitable components and cooperations thereinbetween, as well as other suitable geometrical configurations may be used for the adjustment systems, and corresponding parts, according to various embodiments, as briefly explained and as can easily be inferred herefrom by a person skilled in the art, without departing from the scope.

Figure 1:
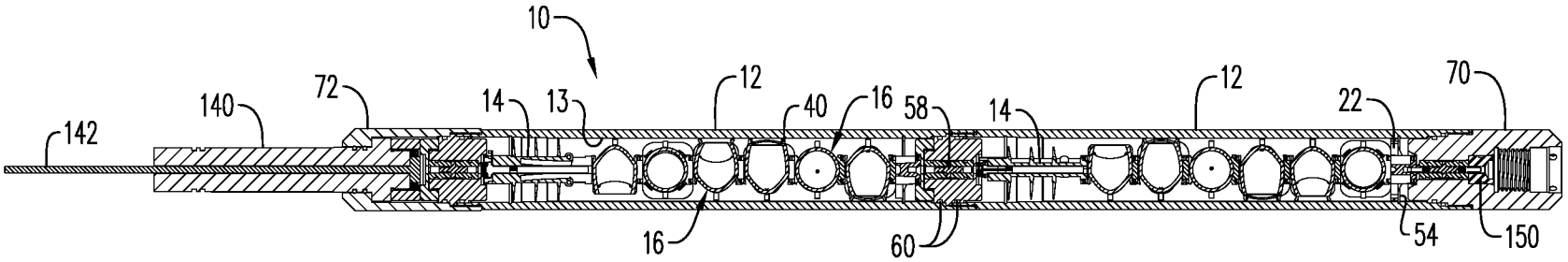
FIG. 1 is a side cut view of a perforation gun system according to an embodiment.
Figure 2:
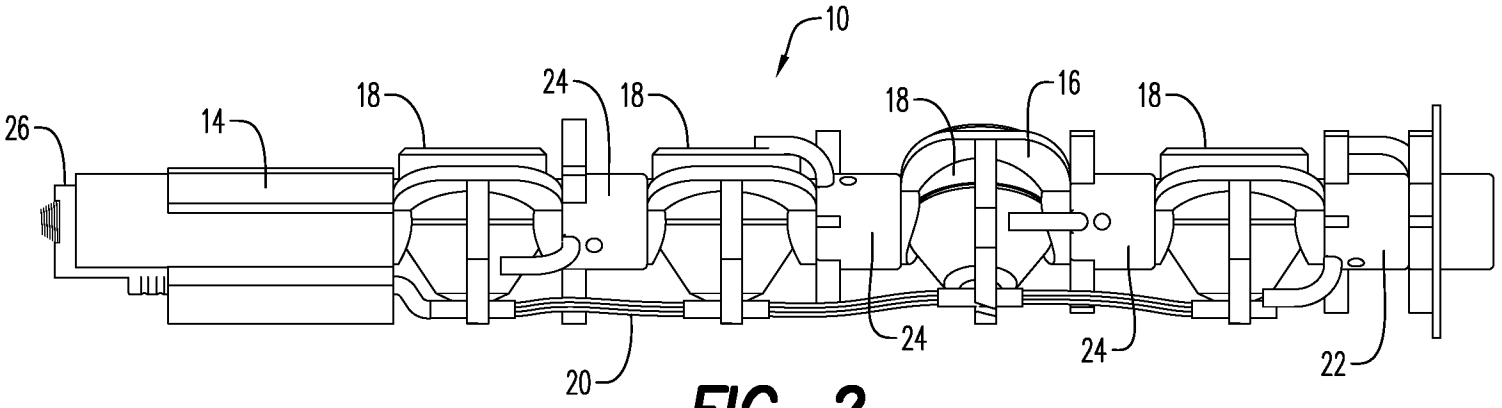
FIG. 2 is a side view of a top connector, bottom connector and stackable charge holders of a perforation gun system in accordance with another embodiment.
Figure 3:
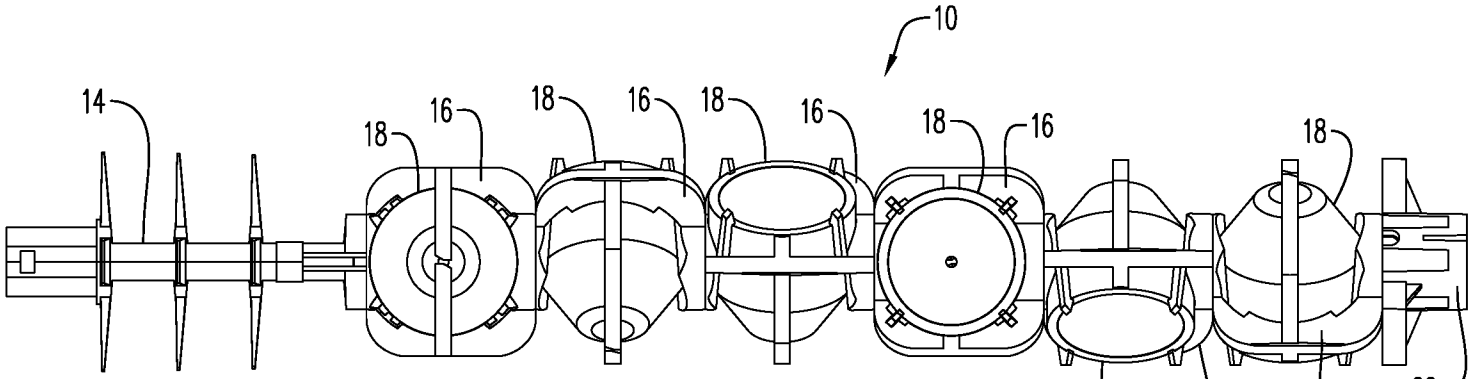
FIG. 3 is a side view of a top connector, bottom connector and stackable charge holders of a perforation gun system in accordance with another embodiment.
Figure 6:
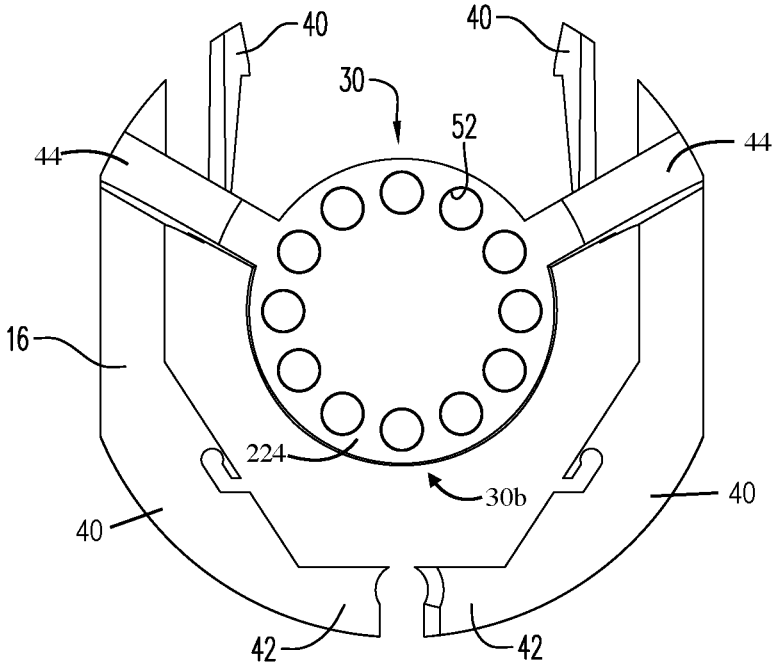
FIG. 6 is a front view of a stackable charge holder in accordance with an embodiment.
Figure 7:
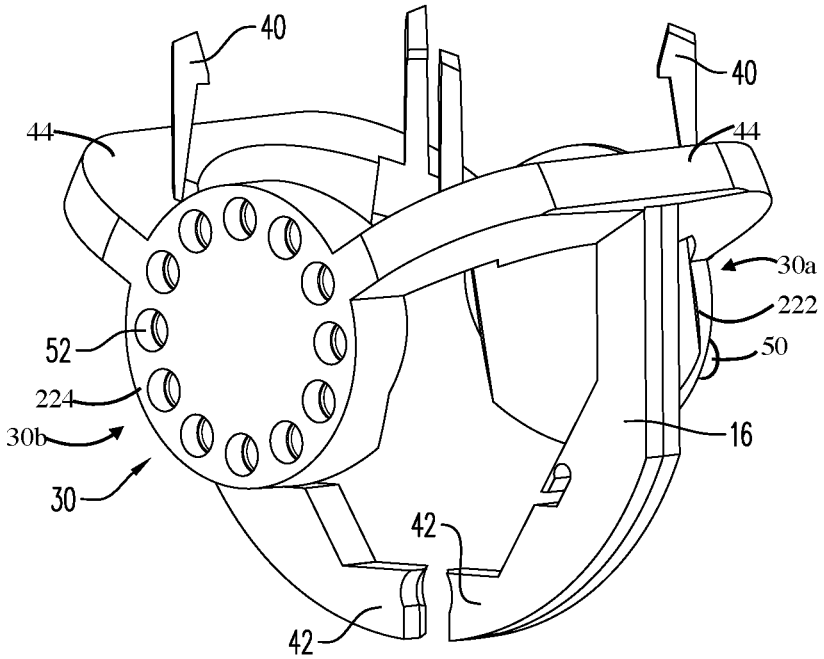
FIG. 7 is a front perspective view of the stackable charge holder shown in FIG. 6.
Figure 8:
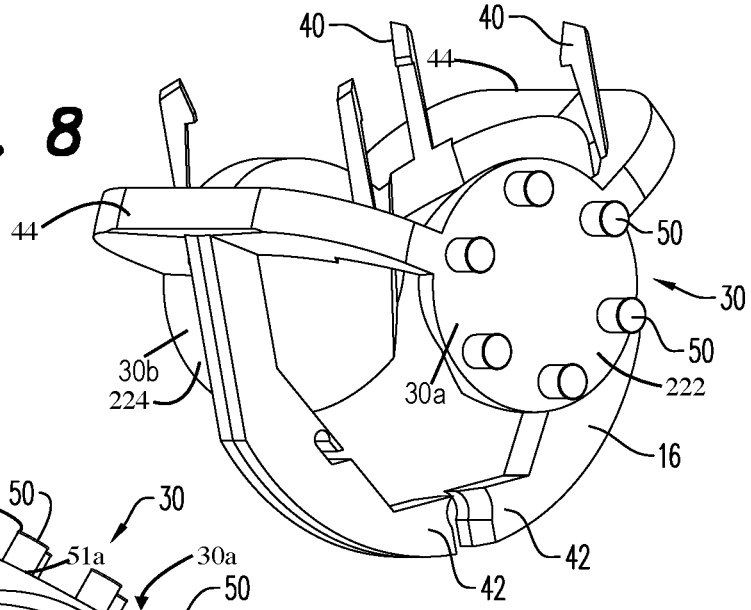
FIG. 8 is a rear perspective view of the stackable charge holder shown in FIG. 6.
Figure 9:
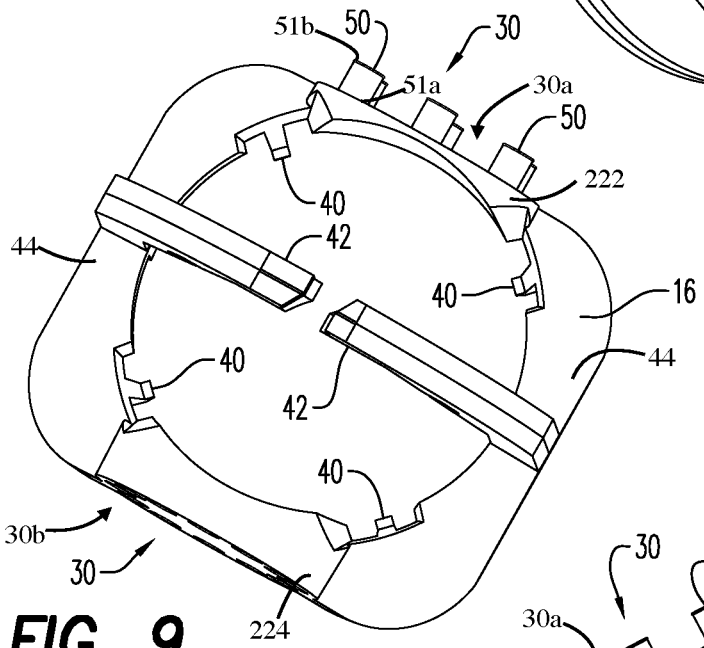
FIG. 9 is a bottom view of the stackable charge holder shown in FIG. 6.
Figure 10:
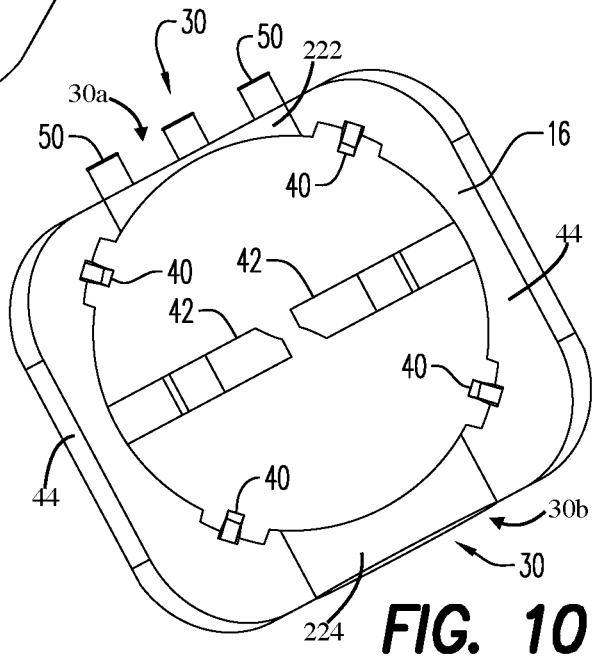
FIG. 10 is a top view of the stackable charge holder shown in FIG. 6.

Referring to FIGS. 1 to 3, an object is to provide a perforation gun system 10 having an outer gun carrier 12. The gun system 10 includes a top connector 14. At least one stackable charge holder 16 is provided for centralizing a single shaped charge 18 within the gun carrier 12. A detonation cord 20 is connected to the top connector 14 and to each stackable charge holder 16.

The gun system 10 includes at least one bottom connector 22 for terminating the detonation cord 20 in the gun system. As better shown in FIG. 2, it is also possible that the bottom connector 22 double as or serve the function of a spacer 24 for spacing a plurality of stackable charge holders 16.

In an embodiment, the gun system also includes a detonator 26 energetically coupled to the detonation cord 20.

As better shown in FIGS. 4 to 18, each of the top connector 14, stackable charge holder 16 and bottom connector 22 includes a rotation coupling 30 for providing a selectable clocking rotation between each of the above-mentioned components. As seen, for instance, in FIGS. 4-5 and 7-9, the rotation coupling 30 includes a first rotation coupling 30*a* and a second rotation coupling 30*b*.

Hence, a user can build multiple configurations of gun systems using various combinations of basic components. A first of these basic components includes a top connector. Another basic component is a single charge holder that centralizes a single shaped charge. The holder is adapted to be stacked and configured into 0, 30, 60, up to 360 degrees or any other combination of these phases for any specified length. Another basic component is a bottom connector that terminates the detonation cord in the gun. The bottom connector may carry as well an electrical connection therethrough. The bottom connector may also double as an imperial measurement stackable spacer to provide any gun shot density up to, for example, 6 shots per foot. Alternately, another bottom connector may be provided or configured to double as a metric measurement stackable spacer to provide any gun shot density up to, for example, 20 shots per meter. Another basic component includes a push-in detonator that does not use wires to make necessary connections. The push-in detonator may uses spring-loaded connectors, thus replacing any required wires and crimping.

Therefore, within the self-centralizing charge holder system, any number of spacers can be used with any number of holders for any specific metric or imperial shot density, phase and length gun system.

In an embodiment, only two pipe wrenches are required for assembly on site of the gun system, as no other tools are required.

In an embodiment, the top connector 14 provides energetic coupling between the detonator and detonating cord.

In an embodiment, each of the top connector 14, stackable charge holder 16 and bottom connector 22 are configured to receive electrical connections therethrough.

In an embodiment, all connections are made by connectors, such as spring-loaded connectors, instead of wires, with the exception of the through wire that goes from the top connector 14 to the bottom connector 22, whose ends are connectors.

In an embodiment, components of the assembly may include molded parts, which may also be manufactured to house the wiring integrally, through, for instance, overmolding, to encase the wiring and all connectors within an injection molded part. For example, the charge holder 16 could be overmolded to include the through wire.

Figure 19:
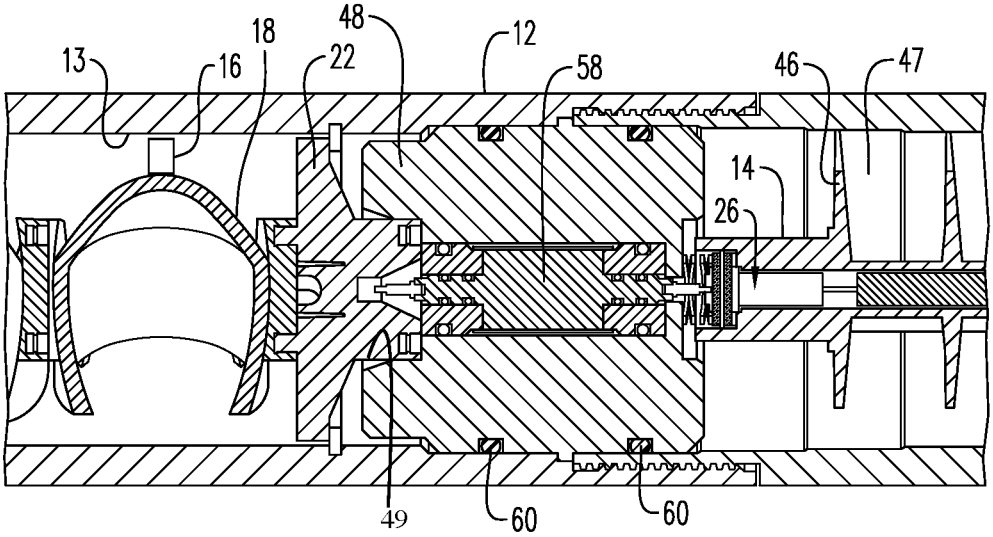
FIG. 19 is an enlarged detailed side cut view of a portion of the perforation gun system including a bulkhead and stackable charge holders shown in FIG. 1.

In an embodiment, and as shown in FIGS. 4 and 5, each bottom connector 22 includes a cylindrical body 220 comprising a first base 222 and a second base 224. The pins 50 outwardly extend from the first base 222, and the sockets 52 at least partially extend into the second base 224. As illustrated in FIGS. 4 and 5, each socket 52 is spaced apart from an adjacent socket and each pin 50 is spaced apart from an adjacent pin. The cylindrical body 220 may include a plurality of alternating v-shaped channels 221 and v-shaped walls 223. The v-shaped channels partially extend from the first base 222 towards the second base 224, and the v-shaped walls 223 extend from the second base 224 to the first base 222. At least one of the pins 50 of the rotation coupling 30 extend from one of the v-shaped walls 223. According to an aspect, when the bottom connector includes the first rotation coupling 30*a* and the second rotation coupling 30*b*, the cylindrical body 220 extends therebetween. The bottom connector 22 includes a plurality of fins/wings 32 radially extending from the body 220. The wings 32 are configured for axially locking each bottom connector against a snap ring 54, or an equivalent retainment mechanism to keep the charge holder 16 from sliding out of the bottom of carrier 12 as it is handled, (shown on FIG. 1). According to an aspect, and as illustrated in FIG. 19, the bottom connector 22 may be recessed into a recess 49 formed in the tandem seal adapter 48. The bottom connector 22 from a first gun assembly can accommodate or house an electrical connection through a bulkhead assembly 58 to the top connector 14 of a second or subsequent gun assembly, as seen for instance in FIG. 19. The top and bottom connector, as well as the spacer, in an embodiment, are made of 15% glass fiber reinforced, injection molding PA6 grade material, commercially available from BASF under its ULTRAMID® brand, and can provide a positive snap connection for any configuration or reconfiguration. As better shown in FIG. 5, a terminating means structure 34 is provided to facilitate terminating of the detonation cord. The structure 34 may be formed in the first base 222. The snap ring 54 is preinstalled on the bottom of the carrier 12. The assembly can thus shoulder up to the snap ring 54 via the bottom connector fins 32.

In an embodiment and as shown in FIGS. 6 to 10, each stackable charge holder 16 includes a charge receiving structure for receiving a single shaped charge, and a plurality of projections 40 extending from the charge receiving structure. The projections 40 may rest against an inner surface 13 or diameter of the gun carrier 12 (as shown in FIG. 1) and thereby centralizing the shaped charge therewithin. The charge receiving structure may include a pair of arms 44, and each projection 40 may extend from at least one of the arms 44. A pair 42 of the plurality of projections 40 may also be configured for capturing the detonation cord (not shown) traversing each stackable charge holder 16. The pair 42 of the plurality of projections are also used for centralizing the shaped charge within an inner surface of the gun carrier. According to an aspect, the stackable charge holder 15 includes a first base 222 and a second base 224 spaced apart from the first base 222. The arms 44 extend between the first and second bases 222, 224. According to an aspect, the pins 50 outwardly extend from the first base 222, and the sockets 52 at least partially extend into the second base 224. Each pin is spaced apart from an adjacent pin, and each socket 52 is spaced apart from an adjacent socket.

Figure 11:
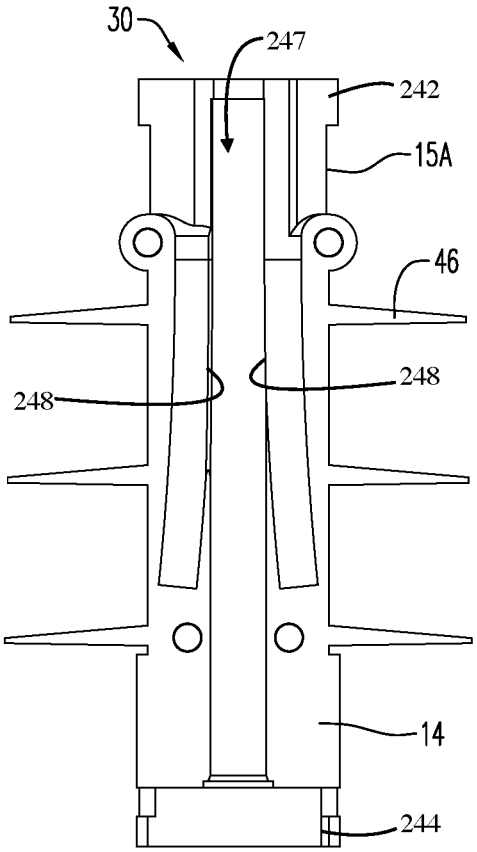
FIG. 11 is a bottom view of a half-portion of a top connector in accordance with an embodiment.
Figure 12:
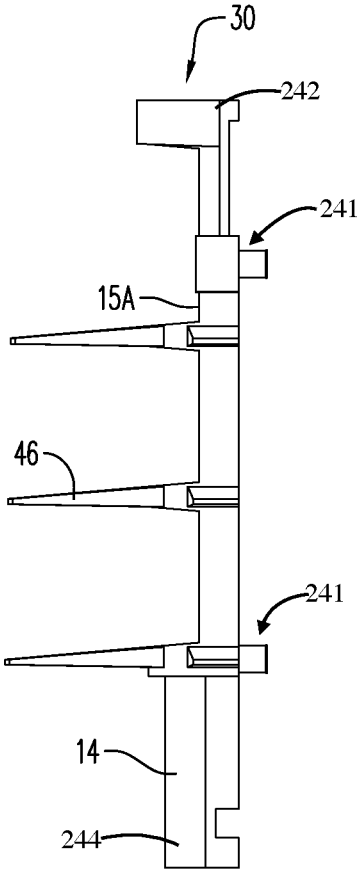
FIG. 12 is a side view of the half-portion of the top connector shown in FIG. 11.
Figure 13:
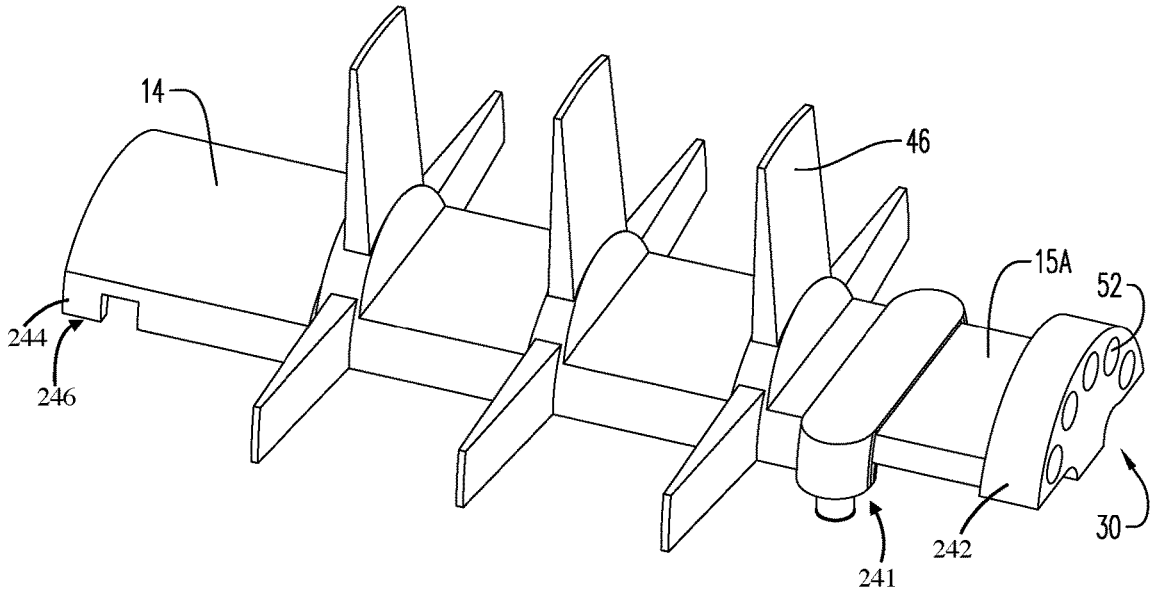
FIG. 13 is a top perspective view of the half-portion of the top connector shown in FIG. 11.
Figure 14:
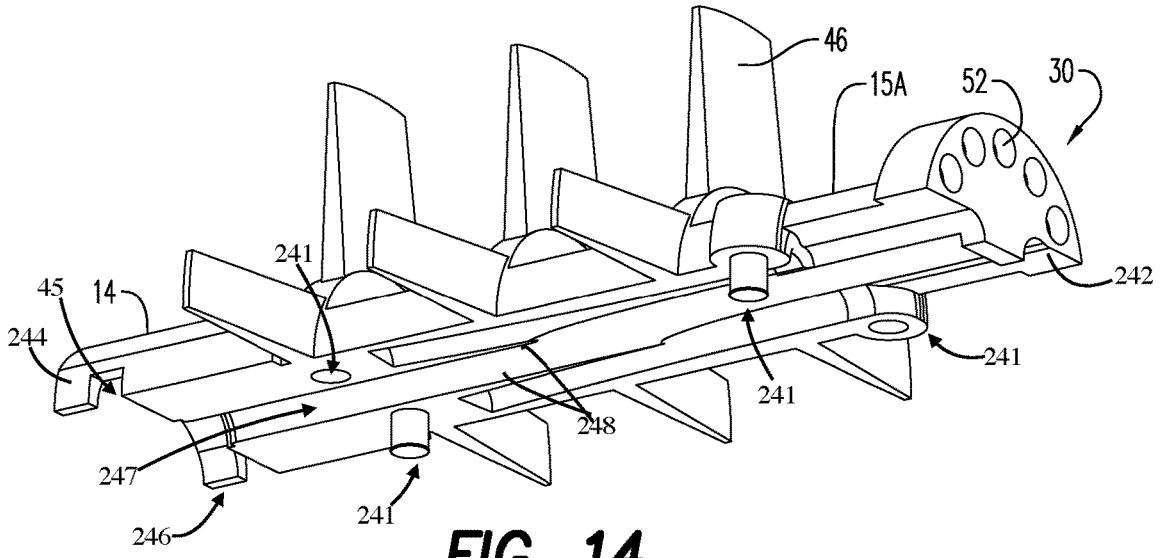
FIG. 14 is a bottom perspective view of the half-portion of the top connector shown in FIG. 11.
Figure 15:
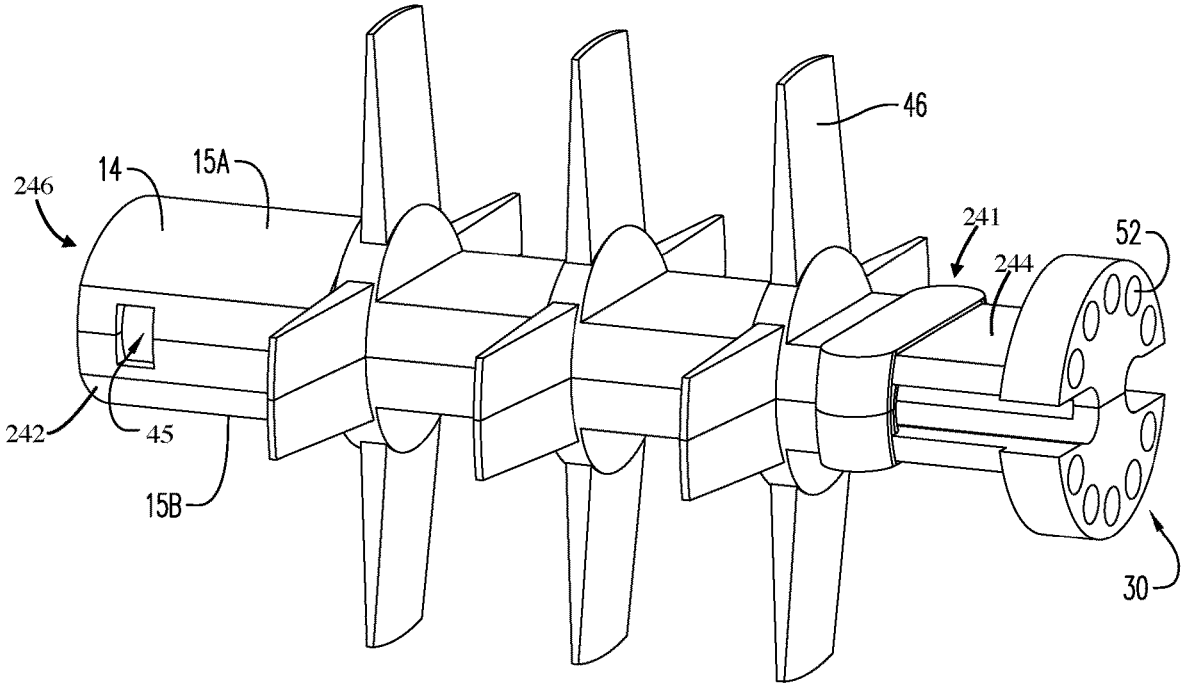
FIG. 15 is a perspective view of a top connector in accordance with an embodiment.
Figure 16:
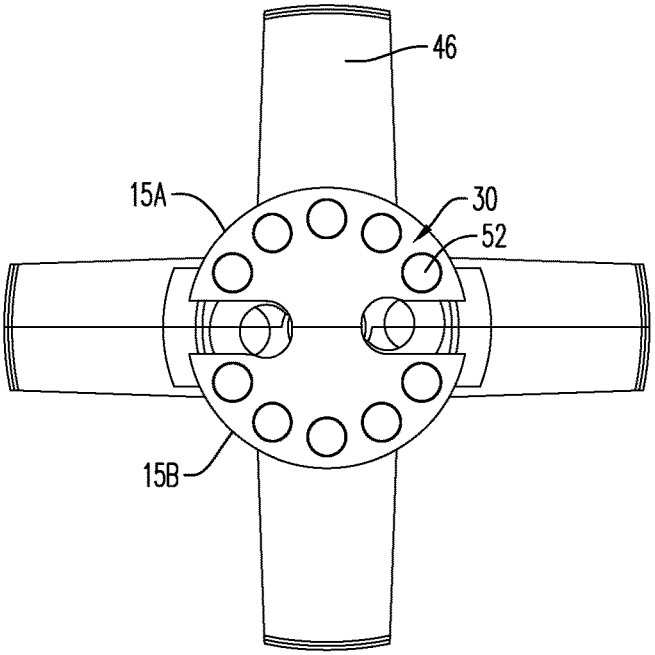
FIG. 16 is a front end view of the top connector shown in FIG. 15.
Figure 17:
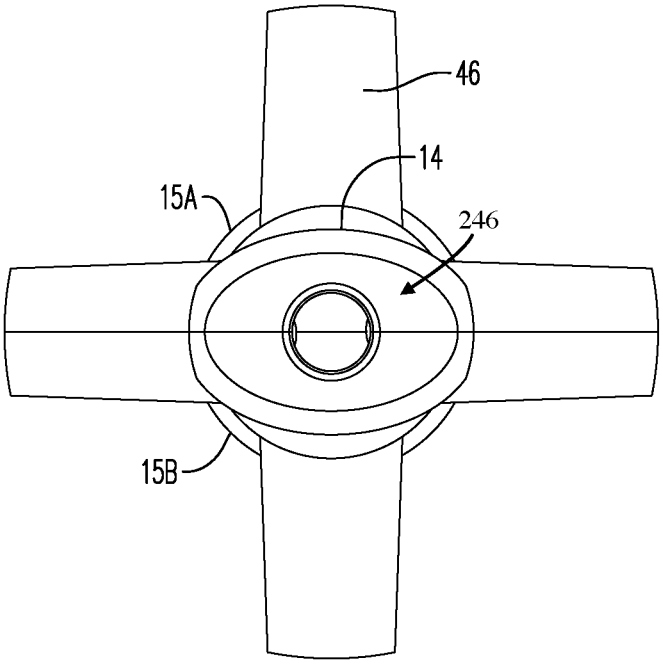
FIG. 17 is a rear end view of the top connector shown in FIG. 15.
Figure 18:
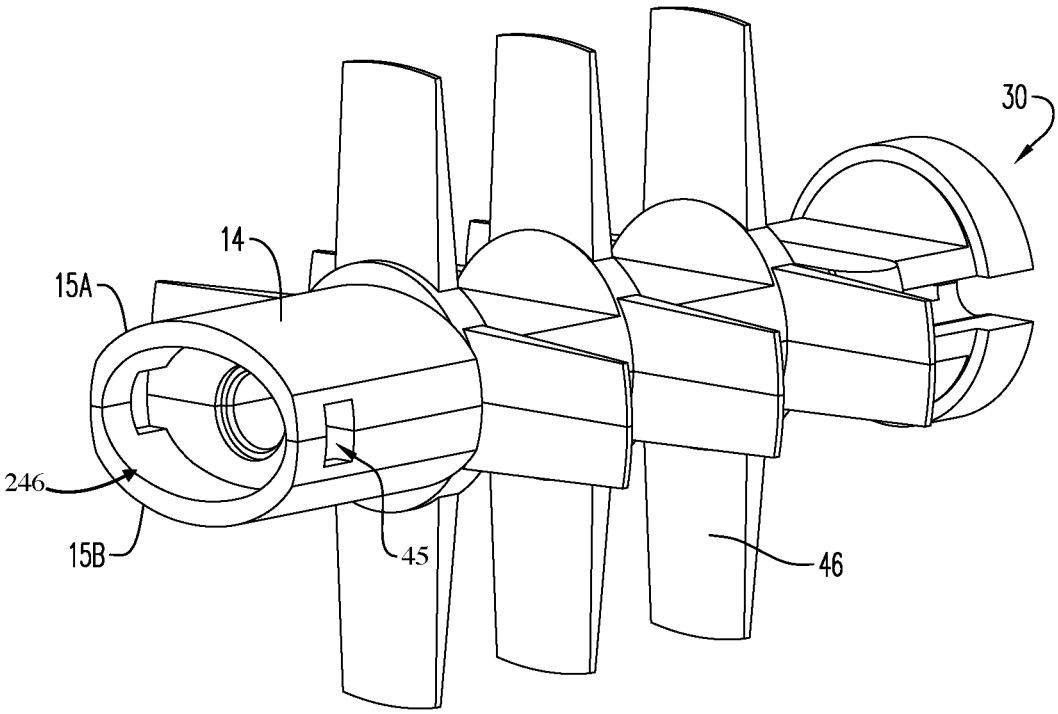
FIG. 18 is a rear perspective view of the top connector shown in FIG. 15.

In an embodiment, as shown in FIGS. 11 to 18, the top connector 14 includes a first end 242, a second end 244, and a coupler 246 formed at the first end 242. The top connector 14 may be configured for providing energetic coupling between the detonator 26 and a detonation cord. According to an aspect and as illustrated in FIGS. 11 and 14, an elongated opening 247 extends from the second end 244, adjacent the coupler 246, towards the first end 242. The elongated opening 247 is flanked by side walls 248 that provide the energetic coupling between the detonator 26 and the detonation cord 20. A rotation coupling 30 is formed at the second end 244. The rotation coupling includes at least one of a plurality of pins 50 and a plurality of sockets 52. According to an aspect, the top connector 14 includes at least one directional locking fin 46. Although the use of directional locking fins is described, other methods of directional locking may be used, in order to eliminate a top snap ring that would otherwise be used to lock the assembly. As better shown in FIG. 19, the locking fins 46 are engageable with corresponding complementarily-shaped structures 47 housed within the carrier 12, upon a rotation of the top connector 14, to lock the position of the top connector along the length of the carrier 12.

In an embodiment, as better shown in FIG. 19, the bottom connector 22 on one end and the top connector 14 on the other end abuts/connects to the bulkhead assembly 58. The tandem seal adapter 48 is configured to seal the inner components within the carrier 12 from the outside environment, using sealing means 60 (shown herein as o-rings). Thus, the tandem seal adapter 48 seals the gun assemblies from each other along with the bulkhead 58, and transmits a ground wire to the carrier 12. Hence, the top connector 14 and bulkhead 58 accommodate electrical and ballistic transfer to the charges of the next gun assembly for as many gun assembly units as required, each gun assembly unit having all the components of a gun assembly.

In an embodiment, the tandem seal adapter 48 is a two-part tandem seal adapter (not shown) that fully contains the bulkhead assembly 58 (comprised of multiple small parts as shown, for instance, in FIG. 19) and that is reversible such that it has no direction of installation.

In an embodiment and as better shown in FIGS. 27-31 and 35A, the detonator assembly 26 includes a detonator head 100, a detonator body 102 and a plurality of detonator wires 104, including a through wire 106, a signal-in wire 108 and a ground wire 110. The through wire 106 traverses from the top to the bottom of the perforating gun system 10, making a connection at each charge holder 16. The detonator head 100 further includes a through wire connector element 112 connected to the through wire 106 (not shown), a ground contact element 114 for connecting the ground wire 110 to the tandem seal adapter (also not shown), through ground springs 116, and a bulkhead connector element 118 for connecting the signal-in wire 108 to the bulkhead assembly 58 (also not shown). Different insulating elements 120A, 120B are also provided in the detonator head 100 for the purpose of insulating the detonator head 100 and detonator wires 104 from surrounding components. As better shown in FIG. 31, a crimp sleeve 122 can be provided to cover the detonator head 100 and body 102, thus resulting in a more robust assembly. The above configuration allows the detonator to be installed with minimal tooling and wire connections.

Figure 32:
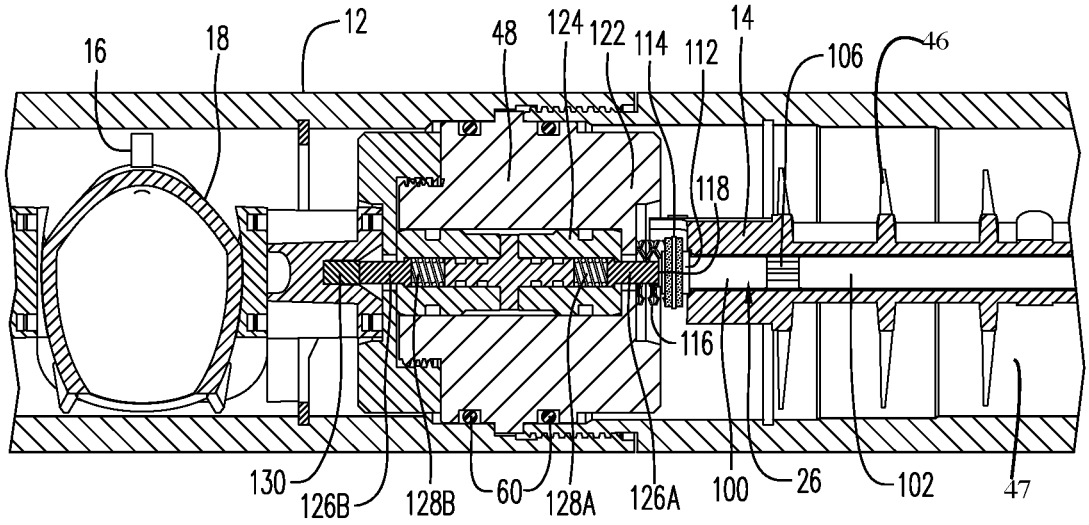
FIG. 32 is a detailed side view of a tandem seal adapter and detonator in accordance with another embodiment.
Figure 33:
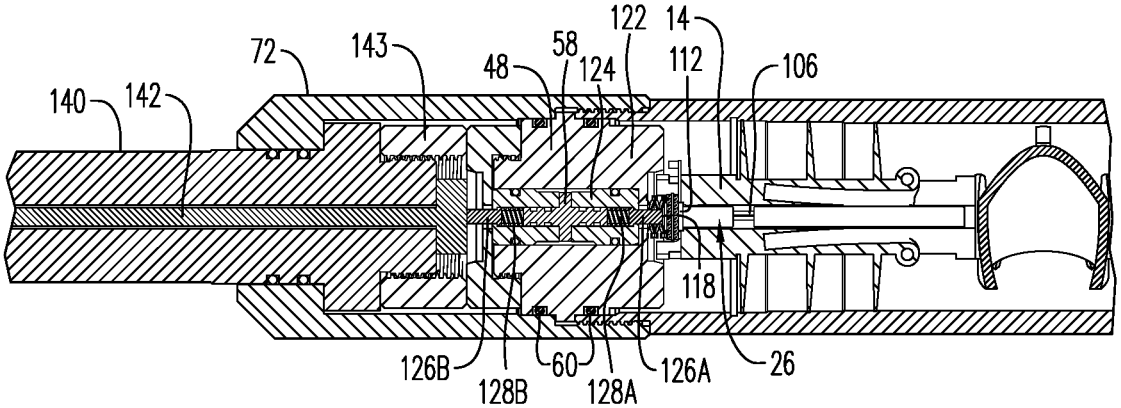
FIG. 33 is a side cut view of a portion of a perforation gun system illustrating the configuration of the top sub in accordance with another embodiment.
Figure 35A:
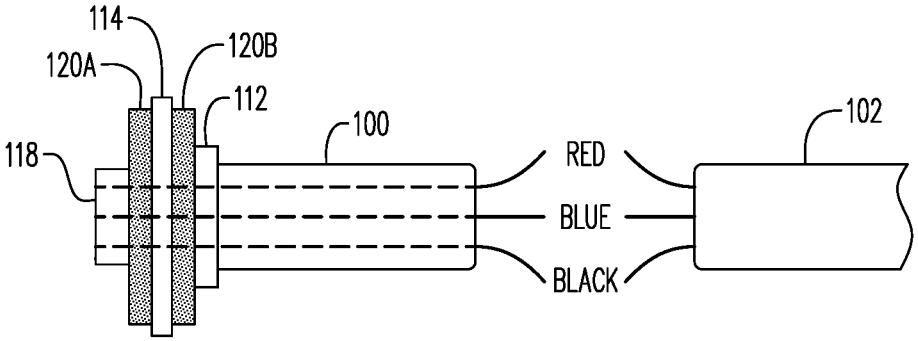
FIGS. 35A and 35B are electrical schematic views of a detonator and of wiring within a perforated gun system in accordance with another embodiment.
Figure 35B:
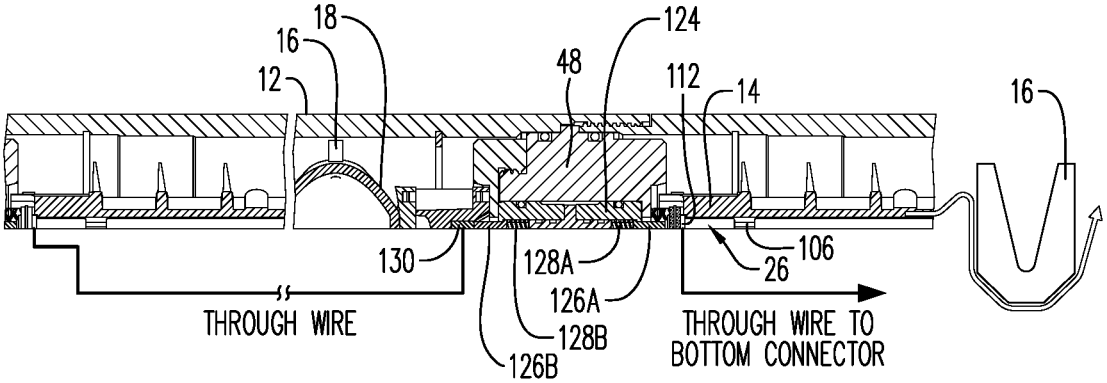

In an embodiment as shown in FIGS. 32, 33 and 35B illustrate a connection of the above-described detonator assembly 26 to the tandem seal adapter 48 and a pressure bulkhead 124. The bulkhead 124 includes spring connector end interfaces comprising contact pins 126A, 126B, linked to coil springs 128A, 128B. This dual spring pin connector assembly including the bulkhead 124 and coil springs 128A, 128B is positioned within the tandem seal adapter 48 extending from a conductor slug 130 to the bulkhead connector element. The dual spring pin connector assembly is connected to the through wire 106 of the detonator assembly 26.

In an embodiment and as better shown in FIGS. 11 to 18, the top connector 14 may have a split design to simplify manufacturing and aid in assembly. By "split design" what is meant is that the top connector 14 can be formed of two halves—a top half 15A and a bottom half 15B. A plurality of securing mechanisms 241 may be provided to couple the top half 15A to the bottom half 15B. As better shown in FIG. 15 or 18, the top connector 14 may also include a blind hole 45 to contain or house the detonation cord, thus eliminating the need for crimping the detonation cord during assembly.

In an embodiment and as shown for example in FIGS. 4 to 18, the rotation coupling 30 may either include a plurality of pins 50 (FIG. 5) symmetrically arranged about a central axis of the rotation coupling 30, or a plurality of sockets 52 (FIG. 4) symmetrically arranged about the central axis of the rotation coupling 30 and configured to engage the plurality of pins 50 of an adjacent rotation coupling 30. The pins each include a first end 51*a*, and a second end 51*b* opposite the first end 51*a*. According to an aspect, the second end 51*b* is wider than the first end 51*a*.

In another embodiment, the rotation coupling 30 may either include a polygon-shaped protrusion, or a polygon-shaped recess configured to engage the polygon-shaped protrusion of an adjacent rotation coupling. The polygon can be 12-sided for example for 30 degree increments.

In another embodiment, the top and bottom subs work with off the shelf running/setting tools as would be understood by one of ordinary skill in the art.

In one embodiment and as shown in FIG. 33, the top sub 72 facilitates use of an off the shelf quick change assembly 140 to enable electrical signals from the surface, as well as to adapt perforating gun system to mechanically run with conventional downhole equipment. The quick change assembly 140 may include a threaded adapter 143 to set an offset distance between an electrical connector 142 and the contact pin 126B extending from the bulkhead assembly 58.

Figure 34:
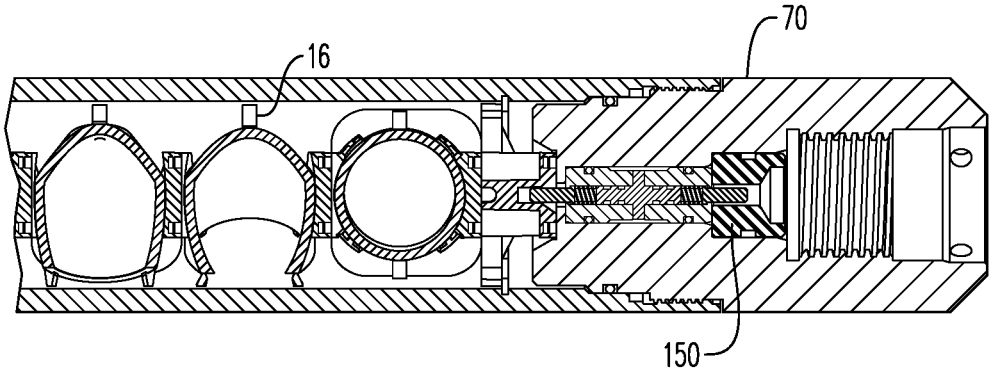
FIG. 34 is a side cut view of a portion of a perforation gun system illustrating the configuration of the bottom sub in accordance with another embodiment.

In one embodiment and as shown in FIG. 34, the bottom sub 70 may be configured as a sealing plug shoot adapter (SPSA) to be used specifically with this embodiment. The SPSA may receive an off the shelf quick change assembly 140 (not shown) and insulator 150 that communicates with a firing head threaded below it (not shown). A setting tool (not shown) may run on the bottom side of the perforating gun.

In an embodiment, final assembly of the tool string requires only two pipe wrenches. No tools are required to install the detonator or any electrical connections.

An object is to also provide a perforation gun system kit having the basic component parts described above and capable of being assembled within an outer gun carrier.

Figure 21:
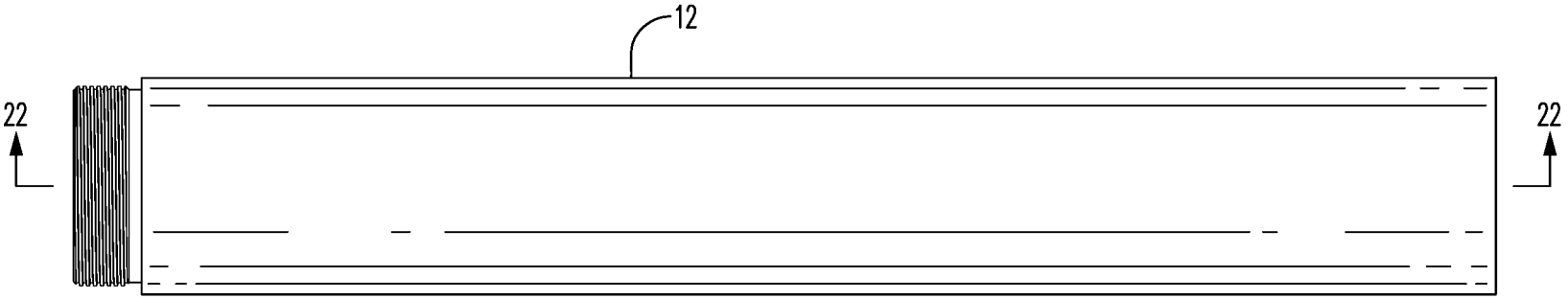
FIG. 21 is a side view of a gun carrier of a gun system in accordance with an embodiment.
Figure 22:
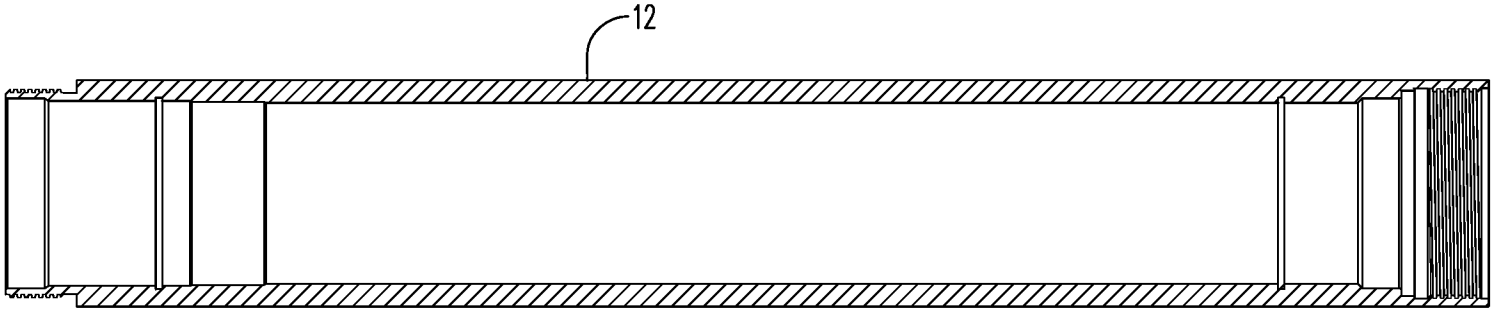
FIG. 22 is a side cut view of the gun carrier shown in FIG. 21.

In an embodiment, a method for assembling a perforation gun system is provided, to which a certain number of optional steps may be provided. The steps for assembling the gun system for transport include the steps of:

providing a perforation gun system kit having component parts capable of being assembled within an outer gun carrier (element 12 in FIGS. 1, 21 and 22), the kit comprising a combination of:

a top connector;

at least one stackable charge holder for centralizing a single shaped charge within the gun carrier;

a detonation cord connectable to the top connector and to each stackable charge holder;

at least one bottom connector adapted for terminating the detonation cord in the gun system and adapted for doubling as a spacer for spacing a plurality of stackable charge holders; and a detonator energetically couplable to the detonation cord, wherein each of the top connector, at least one stackable charge holder and at least one bottom connector comprise a coupling having a plurality of rotational degrees of freedom for providing a selectable rotation between each of the top connector, at least one stackable charge holder and at least one bottom connector;

assembling a plurality of the stackable charge holders in a predetermined phase to form a first gun assembly;

running the detonation cord into a bottommost bottom connector;

assembling the bottommost bottom connector onto the assembled plurality of stackable charge holders;

running a through wire between the bottommost bottom connector and the top connector, so that the through wire goes from the top connector to the bottom connector;

clicking the detonation cord into recesses formed in capturing projections, the capturing projections being provided in each of the charge holders;

running the detonation cord into the top connector;

cutting the detonator cord, if the detonator cord is not precut a predetermined length; and installing charges into each of the charge holders.

In an embodiment, the method further includes, prior to transport, the steps of: pushing assembled components together to engage all pin connections therebetween; and carrying out a continuity test to ensure complete connectivity of the detonating chord.

Figure 20:
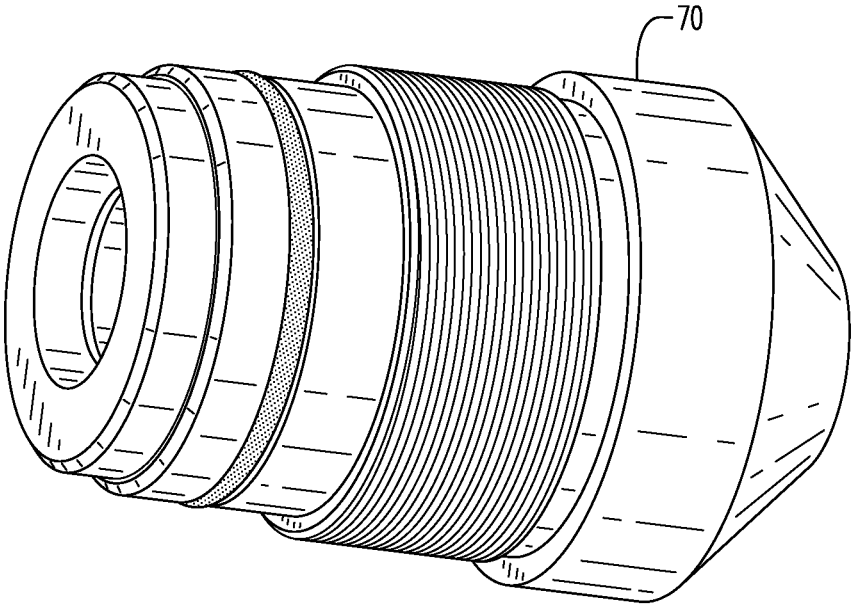
FIG. 20 is a perspective view of a bottom sub of a gun system in accordance with an embodiment.
Figure 23:
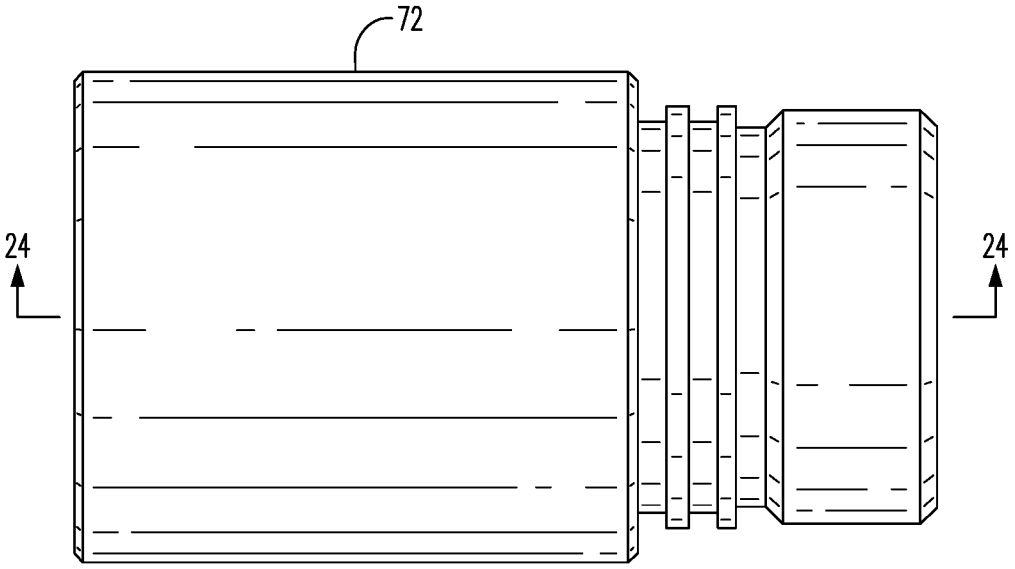
FIG. 23 is a side view of a top sub of a gun system in accordance with an embodiment.
Figure 24:
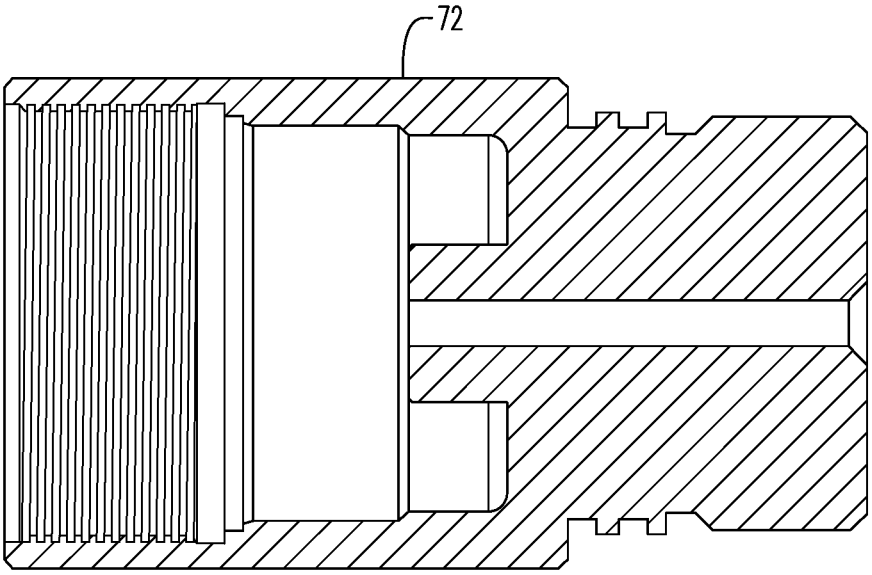
FIG. 24 is a side cut view of the top sub shown in FIG. 23.
Figure 25:
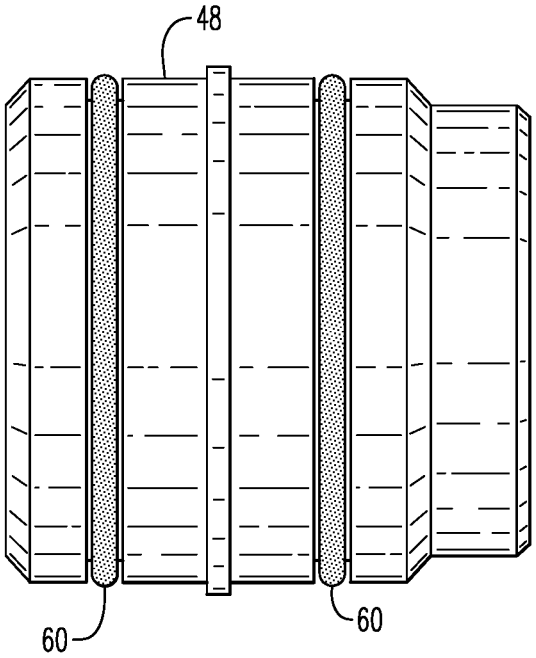
FIG. 25 is a side view of a tandem seal adapter of a gun system in accordance with an embodiment.
Figure 26:
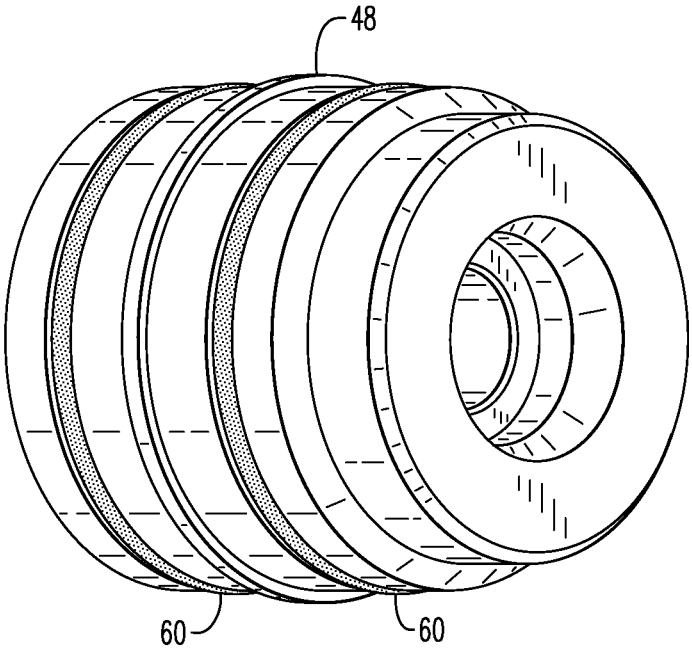
FIG. 26 is a perspective view of the tandem seal adapter shown in FIG. 25.
Figure 27:
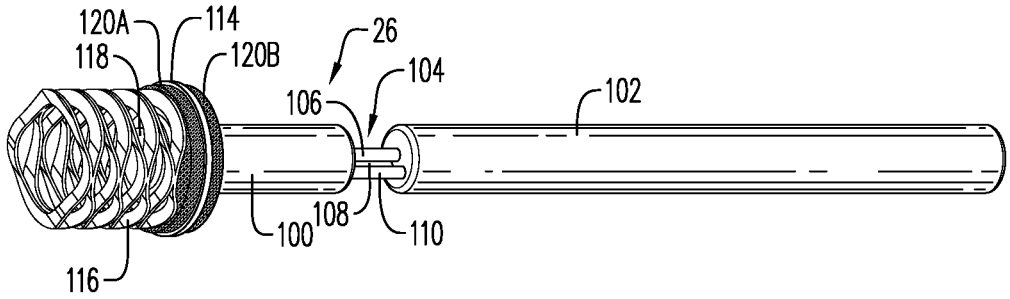
FIG. 27 is a perspective view of a detonator in accordance with an embodiment.
Figure 28:
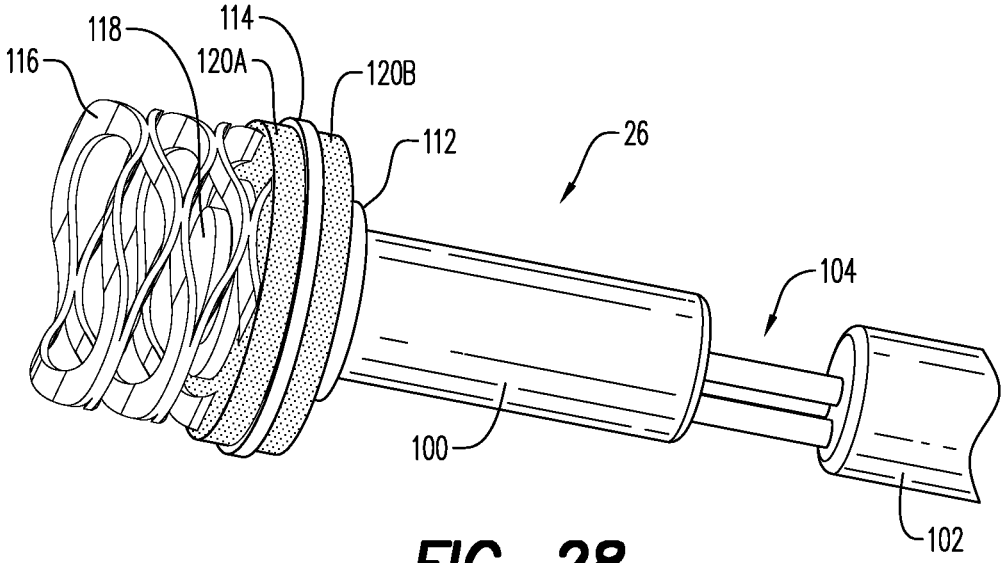
FIG. 28 is a detailed perspective view of the detonator shown in FIG. 27.
Figure 31:
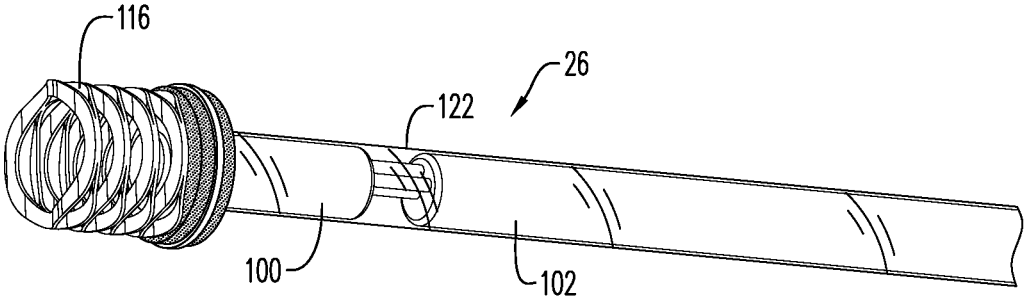
FIG. 31 is another detailed perspective view of the detonator shown in FIG. 27, with a crimp sleeve.

In an embodiment, on location, to complete the assembly, the method further comprises the steps of threading on the previously assembled components a bottom sub (element 70 on FIGS. 1 and 20); installing and connecting the detonator;

pushing in a tandem seal adapter with o-rings onto the first gun assembly;

pushing in a bulkhead (element 58 in FIG. 19) onto the tandem seal adapter, if the bulkhead and the tandem seal adapter are not pre-assembled;

threading a subsequent gun assembly onto the first gun assembly or threading a top sub (element 72 in FIGS. 1, 23 and 24) onto a topmost assembled gun assembly, for connection to a quick change assembly.

Of course, the scope of the perforation gun system, various perforation gun components, the perforation gun system kit, and the method for assembling a perforation gun system should not be limited by the various embodiments set forth herein, but should be given the broadest interpretation consistent with the description as a whole. The components and methods described and illustrated are not limited to the specific embodiments described herein, but rather, features illustrated or described as part of one embodiment can be used on or in conjunction with other embodiments to yield yet a further embodiment. Further, steps described in the method may be utilized independently and separately from other steps described herein. Numerous modifications and variations could be made to the above-described embodiments without departing from the scope of the FIGS. and claims, as apparent to a person skilled in the art.

In this specification and the claims that follow, reference will be made to a number of terms that have the following meanings. The singular forms "a," "an" and "the" include plural referents unless the context clearly dictates otherwise. Further, reference to "top," "bottom," "front," "rear," and the like are made merely to differentiate parts and are not necessarily determinative of direction. Similarly, terms such as "first," "second," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be"

As used in the claims, the word "comprises" and its grammatical variants logically also subtend and include phrases of varying and differing extent such as for example, but not limited thereto, "consisting essentially of" and "consisting of."

Advances in science and technology may make equivalents and substitutions possible that are not now contemplated by reason of the imprecision of language; these variations should be covered by the appended claims. This written description uses examples to disclose the perforation gun system, various perforation gun components, the perforation gun system kit, and the method for assembling a perforation gun system, including the best mode, and also to enable any person of ordinary skill in the art to practice same, including making and using any devices or systems and performing any incorporated methods. The patentable scope of the perforation gun system, various perforation gun components, the perforation gun system kit, and the method for assembling a perforation gun system is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A perforating gun system comprising:

at least one stackable charge holder comprising a charge receiving structure and a plurality of arms configured respectively for receiving and aligning a detonation cord with a shaped charge, and at least one rotation coupling integrated with the stackable charge holder, the rotation coupling comprising a plurality of posts symmetrically arranged about a central axis of the rotation coupling or a plurality of sockets symmetrically arranged about a central axis of the rotation coupling, wherein the posts are configured to engage the plurality of sockets of an adjacent rotation coupling, and the sockets are configured to engage the plurality of posts of an adjacent rotation coupling, and the rotation coupling provides a plurality of rotational degrees of freedom for providing a selectable clocking rotation between the stackable charge holder and components of the perforation gun system.

2. The perforating gun system of claim 1, wherein the charge receiving structure comprises a plurality of projections.

3. The perforation gun system of claim 2, wherein the stackable charge holder comprises:

a first base; and a second base spaced apart from the first base, wherein the projections extend between the first and second bases, the posts outwardly extend from the first base, each of the posts being spaced apart from an adjacent post, and the sockets at least partially extend into the second base, each socket being spaced apart from an adjacent socket.

4. The perforation gun system of claim 3, wherein the at least one rotation coupling comprises:

a first rotation coupling; and a second rotation coupling, wherein the first rotation coupling is integrated with the first base and the second rotation coupling is integrated with the second base, and each of the first rotation coupling and the second rotation coupling comprises at a plurality of posts or a plurality of sockets arranged about the central axis of the rotation coupling.

5. The perforation gun system of claim 4, wherein the posts of the first rotation coupling are configured to engage the sockets of an adjacent rotation coupling; and the sockets of the second rotation coupling are configured to engage the posts of another adjacent coupling.

6. The perforation gun system of claim 2, further comprising:

a pair of the plurality of projections, wherein the pair is configured for centralizing the shaped charge within an inner surface of a perforating gun carrier.

7. A perforating gun system comprising:

at least one stackable charge holder comprising a charge receiving structure and a plurality of arms configured for aligning a detonation cord;

a shaped charge positioned in the charge receiving structure; and at least one rotation coupling integrated with the stackable charge holder, the rotation coupling comprising a plurality of posts symmetrically arranged about a central axis of the rotation coupling or a plurality of sockets symmetrically arranged about a central axis of the rotation coupling, wherein the rotation coupling provides a plurality of rotational degrees of freedom for providing a selectable clocking rotation between the stackable charge holder and components of the perforation gun system.

8. The perforating gun system of claim 7, wherein the charge receiving structure comprises an open area, and the shaped charge is received in the open area.

9. The perforating gun system of claim 7, further comprising a detonation cord, wherein the detonation cord is captured by the plurality of arms adjacent a back wall of the shaped charge.

10. The perforation gun system of claim 9, wherein the detonation cord is energetically coupled to a detonator.

11. The perforation gun system of claim 7, wherein the stackable charge holder is molded.

12. The perforation gun system of claim 7, wherein the posts are symmetrically arranged about the central axis of the rotation coupling and are configured to engage the plurality of sockets of an adjacent rotation coupling, and the sockets are symmetrically arranged about the central axis of the rotation coupling and are configured to engage the plurality of posts of another adjacent rotation coupling.

13. The perforation gun system of claim 7, wherein the stackable charge holder comprises:

a first base; and a second base spaced apart from the first base, wherein the posts outwardly extend from the first base, each of the posts being spaced apart from an adjacent post, and the sockets at least partially extend into the second base, each socket being spaced apart from an adjacent socket.

14. The perforation gun system of claim 13, wherein the at least one rotation coupling comprises:

a first rotation coupling; and a second rotation coupling, wherein the first rotation coupling is integrated with the first base and the second rotation coupling is integrated with the second base, and each of the first rotation coupling and the second rotation coupling comprises a plurality of posts or a plurality of sockets arranged about the central axis of the rotation coupling.

15. The perforation gun system of claim 7, wherein the at least one rotation coupling comprises:

a first rotation coupling; and a second rotation coupling, wherein the posts of the first rotation coupling are configured to engage the sockets of an adjacent rotation coupling; and the sockets of the second rotation coupling are configured to engage the posts of another adjacent coupling.

16. A perforating gun system comprising:

at least one stackable charge holder comprising a charge receiving structure and a plurality of arms configured for aligning a detonation cord;

a shaped charge positioned in the charge receiving structure; and at least one rotation coupling integrated with the stackable charge holder, the rotation coupling comprising a plurality of male connectors symmetrically arranged about a central axis of the rotation coupling or a plurality of female connectors symmetrically arranged about a central axis of the rotation coupling, wherein the rotation coupling provides a plurality of rotational degrees of freedom for providing a selectable clocking rotation between the stackable charge holder and components of the perforation gun system.

17. The perforating gun system of claim 16, further comprising a detonation cord, wherein the detonation cord is captured by the plurality of arms adjacent a back wall of the shaped charge.

18. The perforation gun system of claim 17, wherein the detonation cord is energetically coupled to a detonator.

19. The perforation gun system of claim 16, wherein the stackable charge holder is injection molded.

20. The perforation gun system of claim 16, wherein the male connectors are symmetrically arranged about the central axis of the rotation coupling and are configured to engage the plurality of female connectors of an adjacent rotation coupling, and the female connectors are symmetrically arranged about the central axis of the rotation coupling and are configured to engage the plurality of male connectors of another adjacent rotation coupling.

* * * * *